US008376417B2

(12) United States Patent
Machida et al.

(10) Patent No.: US 8,376,417 B2
(45) Date of Patent: Feb. 19, 2013

(54) DOOR LATCH APPARATUS FOR VEHICLE

(75) Inventors: Toshio Machida, Toyota (JP); Jun Ishida, Anjo (JP); Shinsuke Takayanagi, Hazu-gun (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 720 days.

(21) Appl. No.: 12/511,655

(22) Filed: Jul. 29, 2009

(65) Prior Publication Data

US 2010/0026014 A1 Feb. 4, 2010

(30) Foreign Application Priority Data

Jul. 30, 2008 (JP) ..... 2008-195748

(51) Int. Cl.
*E05C 3/06* (2006.01)
*E05C 3/16* (2006.01)

(52) U.S. Cl. ..... 292/216; 292/201

(58) Field of Classification Search ..... 292/201, 292/216

See application file for complete search history.

(56) References Cited

U.S. PATENT DOCUMENTS

| | | | | |
|---|---|---|---|---|
| 5,538,298 | A * | 7/1996 | Ikeda | 292/201 |
| 5,938,251 | A * | 8/1999 | Watanabe | 292/201 |
| 6,499,776 | B2 * | 12/2002 | Takamura | 292/201 |
| 6,637,783 | B2 * | 10/2003 | Takamura | 292/201 |
| 6,659,515 | B2 * | 12/2003 | Raymond et al. | 292/201 |
| 6,669,247 | B2 * | 12/2003 | Swan | 292/201 |
| 6,685,239 | B2 | 2/2004 | Yamauchi et al. | |
| 6,698,804 | B2 * | 3/2004 | Shiota et al. | 292/201 |
| 7,125,057 | B2 * | 10/2006 | Coleman et al. | 292/216 |
| 8,061,742 | B2 * | 11/2011 | Machida et al. | 292/201 |
| 2003/0067175 | A1 * | 4/2003 | Shiota et al. | 292/201 |
| 2005/0167991 | A1 * | 8/2005 | Yoneyama | 292/201 |
| 2006/0290142 | A1 * | 12/2006 | Tani et al. | 292/201 |
| 2007/0040391 | A1 * | 2/2007 | Fujihara | 292/201 |
| 2008/0105011 | A1 | 5/2008 | Machida et al. | |

FOREIGN PATENT DOCUMENTS

| | | |
|---|---|---|
| JP | 10-266667 A | 10/1998 |
| JP | 2001-098819 A | 4/2001 |
| JP | 2004-293038 A | 10/2004 |
| JP | 2005-188047 | 7/2005 |

OTHER PUBLICATIONS

U.S. Appl. No. 12/411,761, filed Mar. 26, 2009, Takayanagi et al.
U.S. Appl. No. 11/931,861, filed Oct. 31, 2007, Machida et al.

* cited by examiner

*Primary Examiner* — Carlos Lugo
(74) *Attorney, Agent, or Firm* — Buchanan Ingersoll & Rooney PC

(57) ABSTRACT

A door latch apparatus for a vehicle includes a latch, a pawl, a motor, a release power transmitting mechanism, an active rotary member arranged in a standby area in a normal state, a driven rotation member rotating about a rotational shaft arranged in parallel with a rotational shaft of the active rotary member and away therefrom, a cam projection formed at the active rotary member, a cam groove formed at the driven rotation member and slidably engaging with the cam projection, the cam groove extending away from a reference line when the standby area is arranged close to one side of the rotation range and the active rotary member is positioned close to the one side of the rotation range, and a standby state detecting device detecting whether or not the active rotary member is arranged within the standby area based on a rotational position of the driven rotation member.

6 Claims, 23 Drawing Sheets

DOOR LATCH APPARATUS FOR VEHICLE

CROSS REFERENCE TO RELATED APPLICATIONS

This application is based on and claims priority under 35 U.S.C. §119 to Japanese Patent Application 2008-195748, filed on Jul. 30, 2008, the entire content of which is incorporated herein by reference.

FIELD OF THE INVENTION

The present invention relates to a door latch apparatus for a vehicle.

BACKGROUND

A known door latch apparatus for a vehicle such as disclosed in JP10-266667A includes a close power transmitting mechanism for transmitting a rotational power of an electric motor in one direction to a latch so as to drive the latch to rotate in a lock direction where the latch further engages with a striker, thereby shifting a door from a half-latched state to a fully closed state. The aforementioned door latch apparatus generally includes an active rotary member connected to an output shaft of the motor and rotatable in a reciprocating manner within a rotation range specified beforehand. The active rotary member is driven to rotate in one direction by the rotational power of the motor in one direction when the door is in the half-latched state, for example. The active rotary member rotates from a close member contact position where the active rotary member is in contact with a portion of the close power transmitting mechanism to a close completion position by moving from the close power transmitting mechanism by a predetermined close operation angle. As a result, the rotational power of the motor is transmitted to the latch via the close power transmitting mechanism to thereby drive the latch to rotate in the lock direction (i.e., a close operation).

According to the aforementioned door latch apparatus, after the close operation, the active rotary member is required to be positioned away from the close power transmitting mechanism in a normal state, i.e., when the close operation is not performed, so as not to hinder a door opening operation by keeping contact with the close power transmitting mechanism. Thus, the rotation range of the active rotary member includes a standby area of which both ends are defined by the close member contact position and a close member maximum separation position that is away from the close member contact position in the other direction by a predetermined inoperative angle.

FIG. 23A conceptually illustrates the standby area and the rotation range of the active rotary member. As illustrated in FIG. 23A, a standby area Q is defined at one side within a rotation range P. According to the aforementioned explanation, the standby area Q is necessary, however, the large standby area Q may induce an enlargement of the door latch apparatus. Thus, it is desirable for the standby area Q to be minimized. Further, in order to securely position the active rotary member within the standby area in the normal state, a detecting means is inevitable to detect whether or not the active rotary member is positioned within the standby area Q. In order to minimize the standby area, the detecting means having an excellent accuracy and thus being expensive is required. However, because of a high cost competition of these days, the door latch apparatus manufactured at a low cost by reducing a cost relating to the detecting means is desired.

On the other hand, a different structure is considerable in which a driven rotation member is provided for rotating in conjunction with the active rotary member over the entire rotation range of the active rotary member. The driven rotation member rotates wider than the active rotary member. Whether or not the active rotary member is positioned within the standby area is detected by a detection of a position of the driven rotation member.

In connection with the above, JP10-266667A discloses a latch and a rotary lever rotatably provided at a side of the latch. The latch and the rotary lever are connected by means of a cam projection and a cam groove so as to be rotatable in conjunction with each other. A rotation position of the latch is detected as a rotation position of the rotary lever. Then, when the latch is positioned at a center of the rotation range, the cam projection is positioned on a reference line connecting a rotation center of the latch and a rotation center of the rotary lever. At this time, the cam groove also overlaps the same reference line so that the cam groove is in parallel with the reference line. As a result, an overall length of the rotary lever is configured to be shortened. However, because the latch rotates rapidly at a time of opening or closing of the door, the rotary lever and the detecting means are required to have durability against the rapid rotation of the latch, which may prevent a reduction of cost.

Further, in a case where the latch is simply replaced by the active rotary member for applying a technology disclosed in JP10-266667A to a position detection of the active rotary member, the following structure is obtained. As illustrated in FIG. 23B, a cam projection 3 is positioned on a reference line S1 connecting a rotation center 1A of an active rotary member 1 and a rotation center 2A of a rotary lever 2 when the active rotary member 1 is positioned at a center of the rotation range P. At this time, a cam groove 4 provided at the rotary lever 2 is in parallel with the reference line S1 in a state where the cam groove 4 overlaps the reference line S1. In such structure, a rotation angle of the rotary lever 2 per unit rotation angle of the active rotary member 1 is largest in the vicinity of the center of the rotation range P. The rotation angle of the rotary lever 2 is gradually decreasing towards the vicinity of both ends of the rotation range P from the center thereof. Thus, within the standby area Q defined at one side within the rotation range P, the rotation angle of the rotary lever 2 while the active rotary member 1 rotates from one end to the other end of the standby area Q is small. As a result, even for detecting whether or not the rotary lever 2 is positioned within the standby area Q, the detecting means having the high accuracy is required.

A need thus exists for a door latch apparatus for a vehicle which is not susceptible to the drawback mentioned above.

SUMMARY OF THE INVENTION

According to an aspect of the present invention, a door latch apparatus for a vehicle includes a latch adapted to be mounted to a door for the vehicle and rotating by engaging with a striker provided at a vehicle body, a pawl rotatable between a latch engagement position where a rotation of the latch is prohibited and a latch engagement release position where the rotation of the latch is permitted, a motor activated in response to an opening and closing operation of the door, a release power transmitting mechanism transmitting a rotational power of the motor in one direction to the pawl and causing the pawl to rotate from the latch engagement position to the latch engagement release position, an active rotary member connected to an output shaft of the motor and rotatable in a reciprocating manner within a rotation range specified beforehand, the active rotary member transmitting the rotational power of the motor to the pawl via the release power transmitting mechanism by rotating in a first direction from a release member contact position where the active rotary member is in contact with a portion of the release power transmitting mechanism to a release completion position achieved by the active rotary member moving by a predetermined release operation angle from the release member contact position in a case where the door is operated to open, the active rotary member being arranged in a standby area defined between the release member contact position and a release member maximum separation position separated from the release member contact position in a second direction by a predetermined inoperative angle in a case where the active rotary member is in a normal state where the door not operated to open, a driven rotation member rotating about a rotational shaft which is arranged in parallel with a rotational shaft of the active rotary member and at a position away from the active rotary member, the driven rotation member overlapping the active rotary member, a cam projection formed in a projecting manner at a surface of the active rotary member where the driven rotation member overlaps, a cam groove formed at the driven rotation member and slidably engaging with the cam projection for causing the active rotary member and the driven rotation member to operate in conjunction with each other, the cam groove extending at a position away from a reference line that connects a rotational center of the active rotary member and a rotational center of the driven rotation member in a case where the standby area is arranged close to one side of the rotation range and the active rotary member is positioned close to the one side of the rotation range, and a standby state detecting device detecting whether or not the active rotary member is arranged within the standby area based on a rotational position of the driven rotation member.

According to another aspect of the present invention, a door latch apparatus for a vehicle includes a latch adapted to be mounted to a door for the vehicle and rotating by engaging with a striker provided at a vehicle body, a pawl rotatable between a latch engagement position where a rotation of the latch is prohibited and a latch engagement release position where the rotation of the latch is permitted, a motor activated in response to an opening and closing operation of the door, a close power transmitting mechanism transmitting a rotational power of the motor in one direction to the latch and causing the latch to rotate in a lock direction in which the latch further engages with the striker for bringing the door in a fully closed state, an active rotary member connected to an output shaft of the motor and rotatable in a reciprocating manner within a rotation range specified beforehand, the active rotary member transmitting the rotational power of the motor to the latch via the close power transmitting mechanism by rotating in a first direction from a close member contact position where the active rotary member makes contact with a portion of the close power transmitting mechanism to a close completion position achieved by the active rotary member rotating by a predetermined close operation angle from the close member contact position in a case where the door is in a half-latched state, the active rotary member being arranged in a standby area defined between the close member contact position and a close member maximum separation position separated from the close member contact position in a second direction by a predetermined inoperative angle in a case where the active rotary member is in a normal state where the door is not operated to close, a driven rotation member rotating about a rotational shaft which is arranged in parallel with a rotational shaft of the active rotary member and at a position away from the active rotary member, the driven rotation member overlapping the active rotary member, a cam projection formed in a projecting manner at a surface of the active rotary member where the driven rotation member overlaps, a cam groove formed at the driven rotation member and slidably engaging with the cam projection, the cam groove slidably engaging with the cam projection for causing the active rotary member and the driven rotation member to operate in conjunction with each other, the cam groove extending at a position away from a reference line that connects a rotational center of the active rotary member and a rotational center of the driven rotation member in a case where the standby area is arranged close to one side of the rotation range and the active rotary member is positioned close to the one side of the rotation range, and a standby state detecting device detecting whether or not the active rotary member is arranged within the standby area based on a rotational position of the driven rotation member.

According to still another aspect of the present invention, a door latch apparatus for a vehicle includes a latch adapted to be mounted to a door for the vehicle and rotating by engaging with a striker provided at a vehicle body, a pawl rotatable between a latch engagement position where a rotation of the latch is prohibited and a latch engagement release position where the rotation of the latch is permitted, a motor activated in response to an opening and closing operation of the door, a release power transmitting mechanism transmitting a rotational power of the motor in one direction to the pawl and causing the pawl to rotate from the latch engagement position to the latch engagement release position, a close power transmitting mechanism transmitting the rotational power of the motor in the other direction to the latch and causing the latch to rotate in a lock direction in which the latch further engages with the striker for bringing the door in a fully closed state, an active rotary member connected to an output shaft of the motor and rotatable in a reciprocating manner within a rotation range specified beforehand, the active rotary member transmitting the rotational power of the motor to the pawl via the release power transmitting mechanism by rotating in a first direction from a release member contact position where the active rotary member is in contact with a portion of the release power transmitting mechanism to a release completion position achieved by the active rotary member moving by a predetermined release operation angle from the release member contact position in a case where the door is operated to open, the active rotary member transmitting the rotational power of the motor to the latch via the close power transmitting mechanism by rotating in a second direction from a close member contact position where the active rotary member makes contact with a portion of the close power transmitting mechanism to a close completion position achieved by the active rotary member rotating by a predetermined close operation angle from the close member contact position in a case where the door is in a half-latched state, the active rotary member being arranged in a standby area defined between the close member contact position and the release member contact position in a case where the active rotary member is in a normal state where the door is prevented from being operated to open or operated to close, a driven rotation member rotating about a rotational shaft which is arranged in parallel with a rotational shaft of the active rotary member and at a position away from the active rotary member, the driven rotation member overlapping the active rotary member, a cam projection formed in a projecting manner at a surface of the active rotary member where the driven rotation member overlaps, a cam groove formed at the driven rotation member and slidably engaging with the cam projection, the cam groove slidably engaging with the cam projection for causing the active rotary member and the driven rotation member to operate in conjunction with each other, the cam groove extending at a position away from a reference line that connects a rotational center of the active rotary member and a rotational center of the driven rotation member in a case where the standby area is arranged close to one side of the rotation range and the active rotary member is positioned close to the one side of the rotation range, and a standby state detecting device detecting whether or not the active rotary member is arranged within the standby area based on a rotational position of the driven rotation member.

BRIEF DESCRIPTION OF THE DRAWINGS

The foregoing and additional features and characteristics of the present invention will become more apparent from the following detailed description considered with the reference to the accompanying drawings, wherein.

DETAILED DESCRIPTION

Figure 1:
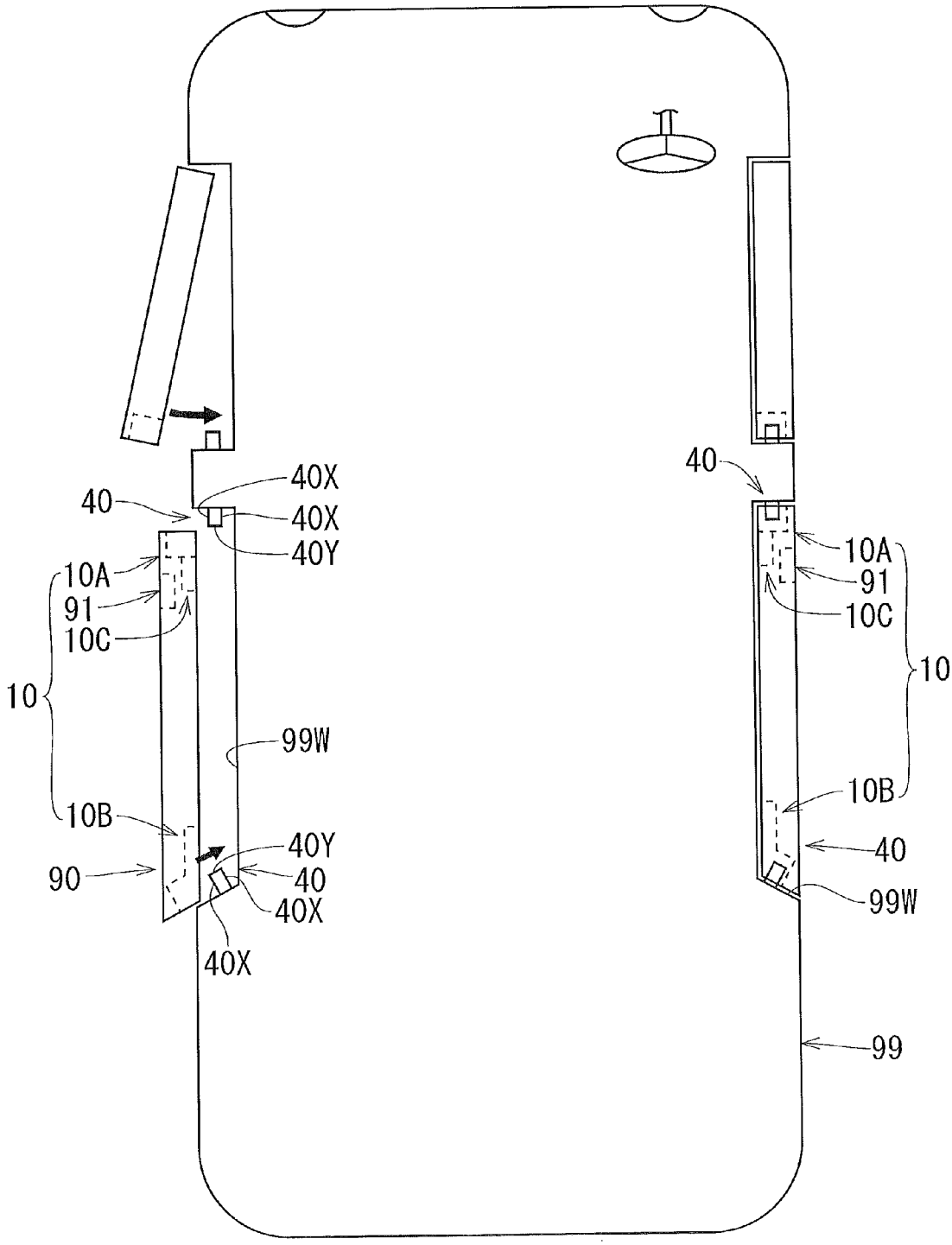
FIG. 1 is a schematic diagram illustrating a vehicle including a door lock system according to an embodiment of the present invention.

An embodiment of the present invention will be explained with reference to the attached drawings. In FIG. 1, a vehicle including a slide door 90 having a door lock system for a vehicle 10 (hereinafter simply referred to as a door lock system 10) is illustrated. The slide door 90 serving as a door moves obliquely rearward of the vehicle in a state where an opening portion of a vehicle body 99 is closed and then moves straight rearward to be positioned at a fully open position (i.e., the slide door 90 is in a fully open state). The door lock system 10 includes a closed door lock device 10A for maintaining the slide door 90 in a closed state, a fully opened door lock device 10C for maintaining the slide door 90 in a fully open state, a closure device 10B for bringing the slide door 90 to a fully closed state from a half-latched state, and a remote control device 91.

Figure 2:
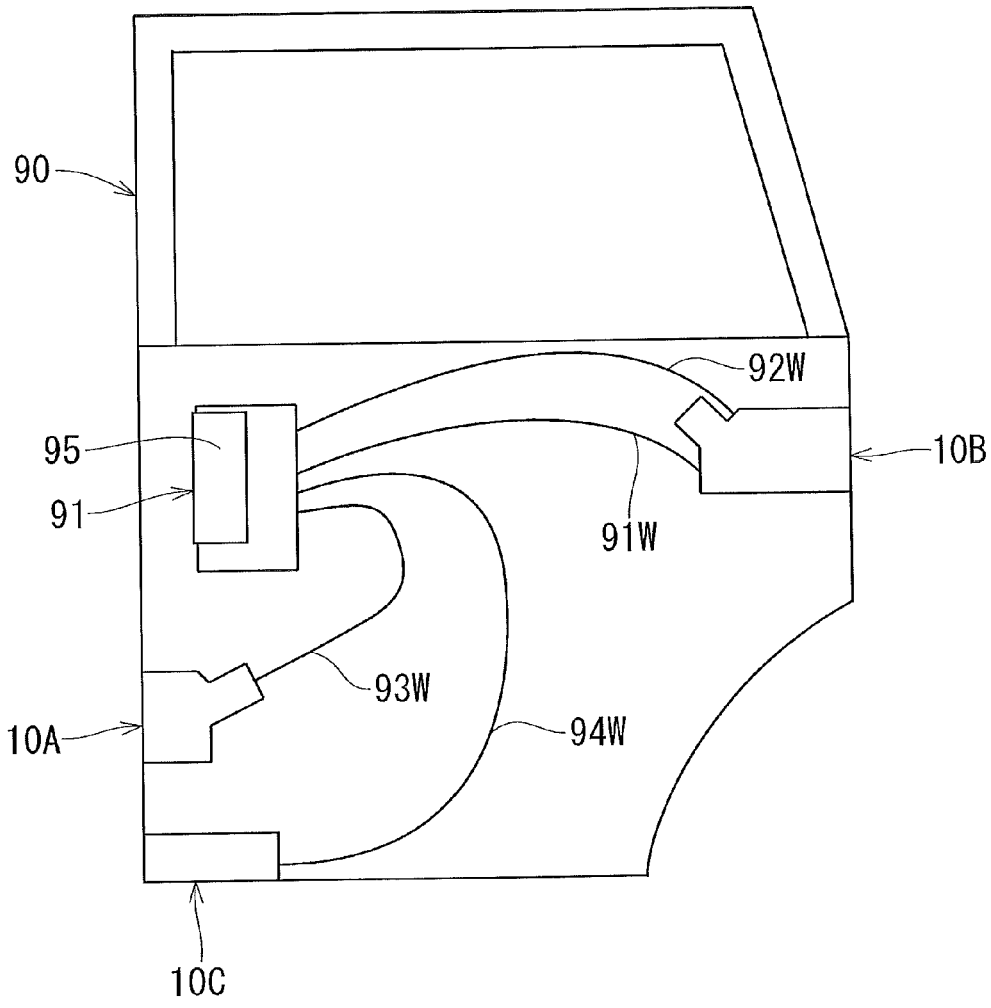
FIG. 2 is a schematic diagram illustrating a slide door including the door lock system.

As illustrated in FIG. 2, the closed door lock device 10A is provided at a substantially intermediate portion in a height direction at a front edge of the slide door 90. The fully opened door lock device 10C is provided at a lower end portion in the height direction at the front edge of the slide door 90. The closure device 10B is provided at a substantially intermediate portion in the height direction at a rear edge of the slide door 90. According to the present embodiment, strikers 40 are provided in three places corresponding to the closed door lock device 10A, the fully opened door lock device 10C, and the closure device 10B, respectively, at an inner surface of a doorframe 99W (i.e., a frame of the opening portion).

Each of the strikers 40 is obtained by, for example, a wire rod having a circular shape in a cross section to be bent so as to have a portal structure. That is, each of the strikers 40 is constituted by two legs 40X, 40X, and a connecting rod 40Y provided between respective tip ends of the legs 40X, 40X for connecting the legs 40X, 40X to each other. The striker 40 for the closed door lock device 10A extends in a substantially horizontally rearward direction from the inner surface at a front side of the doorframe 99W. In addition, the legs 40X, 40X are arranged in inner and outer directions of the doorframe 99W. The closed door lock device 10A engages with the leg 40X provided near the outside of the doorframe 99W. In FIGS. 3 to 6, only a cross section of a portion of the striker 40 that engages with the closed door lock device 10A is illustrated. The striker 40 for the closure device 10B extends in a substantially horizontally forward direction from the inner surface at a rear side of the doorframe 99W. In addition, the legs 40X, 40X are arranged in inner and outer directions of the doorframe 99W. The closure device 10B engages with the leg 40X provided near the outside of the doorframe 99W. As for the striker 40 for the fully opened door lock device 10C, which is not illustrated in FIG. 2, the legs extend in the substantially horizontally forward direction from the inner surface at the rear side of the doorframe 99W and are arranged side by side in a vertical direction of the vehicle. The fully opened door lock device 10C engages with a connecting rod.

Figure 3:
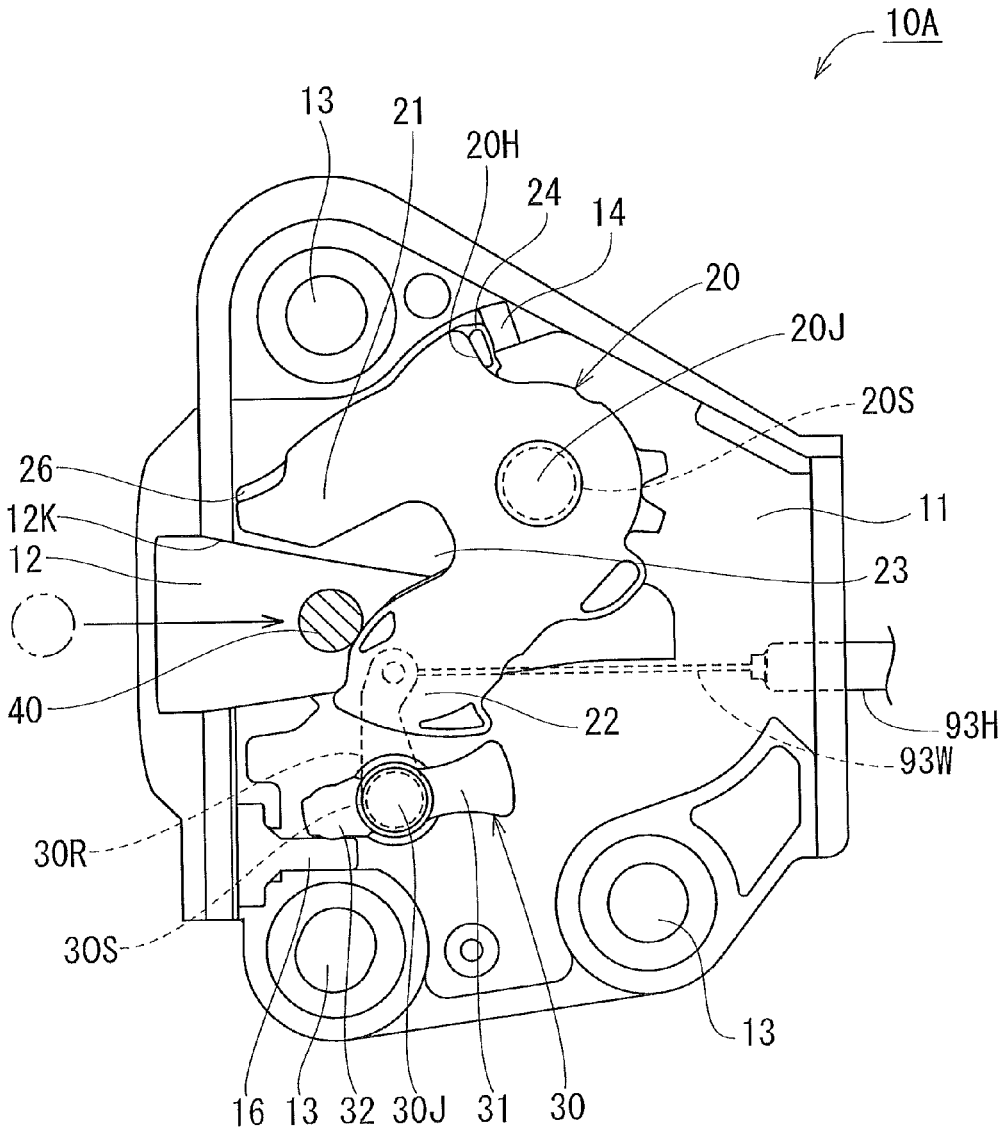
FIG. 3 is a front view of a closed door lock device in an unlatched state.

As illustrated in FIG. 3, the closed door lock device 10A includes a base 11 on which a latch 20 and a pawl 30 are rotatably assembled. The base lever 11 includes multiple bolt fixing bores 13 through which bolts, which are applied to a front end wall of the slide door 90 from an inner side, are inserted (or with which bolts are meshed) so as to fix the closed door lock device 10A to the slide door 90.

The base lever 11 includes a striker receiving groove 12 that extends in a horizontal direction. One end of the striker receiving groove 12 forms an opening portion 12K that opens towards a vehicle interior. The other end of the striker receiving groove 12 is closed. A cutout facing the striker receiving groove 12 is formed at one end wall of the slide door 90 where the base lever 11 is attached. When the slide door 90 is closed, the striker 40 enters the striker receiving groove 12 through the opening portion 12K.

The pawl 30 is rotatably supported by the base 11. Specifically, the pawl 30 is provided at a lower portion of the base 11 than a portion where the striker receiving groove 12 is provided. The pawl 30 includes a latch rotation restricting piece 31 and a stopper piece 32, which extend in opposite directions to each other from a rotational shaft 30J. A torsion spring 30S is disposed between the pawl 30 and the base 11 for biasing the pawl 30 in a counterclockwise direction in FIG. 3. Normally, the stopper piece 32 makes contact with a pawl stopper 16 provided at the base 11 for positioning the pawl 30.

The pawl 30 further includes a pawl drive lever 30R beyond the base 11, i.e., on an opposite side of the latch rotation restricting piece 31 and the stopper piece 32 relative to the base 11. The pawl drive lever 30R and the remote control device 91 are connected to each other by means of an open cable 93W. An intermediate portion of the open cable 93W is covered by a cladding tube 93H. When the open cable 93W is pulled towards the remote control device 91, the pawl 30 rotates in the clockwise direction in FIG. 3, thereby moving the latch rotation restricting piece 31 to a release position which is away from a rotation range of the latch 20 which will be explained later.

The latch 20 is rotatably supported by the base 11. Specifically, the latch 20 is provided at an upper portion of the base 11 than a portion where the sticker receiving groove 12 is provided. The latch 20 is made of a metallic plate coated by a resin layer for the purpose of soundproofing. The latch 20 includes first and second engagement portions 21 and 22 arranged in parallel with each other. A striker receiving portion 23 is formed between the first and second engagement portions 21 and 22. The latch 20 is biased by a torsion spring 20S disposed between the latch 20 and the base 11 in an unlock direction (i.e., a clockwise direction in FIG. 3). In a state where the slide door 90 is open, a stopper contact portion 24 provided at the latch 20 and a latch stopper 14 provided at the base 11 make contact with each other to thereby locate the latch 20 in an unlatched position as illustrated in FIG. 3.

Figure 4:
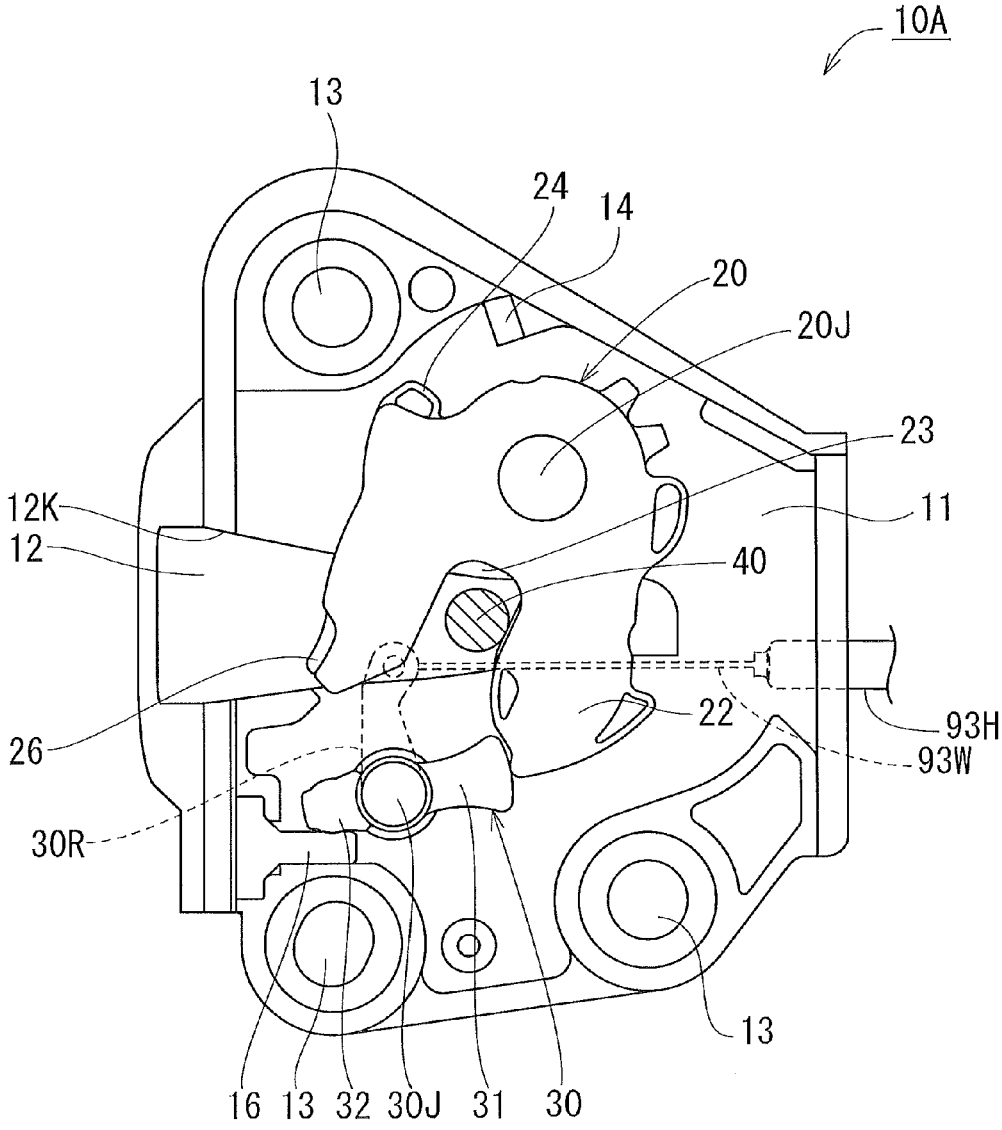
FIG. 4 is a front view of the closed door lock device in a half-latched state.

When the latch 20 is in the unlatched position, the first engagement portion 21 is away from the striker receiving groove 12, specifically, the first engagement portion 21 is arranged above the striker receiving groove 12. The second engagement portion 22 is arranged so as to cross the striker receiving groove 12. An opening end of the striker receiving portion 23 of the latch 20 faces the opening portion 12K of the striker receiving groove 12. The striker 40, which enters the striker receiving groove 12, is received within the striker receiving portion 23 and then pushes the second engagement portion 22 so that the latch 20 rotates in a lock direction (i.e., a counterclockwise direction in FIG. 3). As a result, as illustrated in FIG. 4, a portion of the striker receiving groove 12 close to the opening portion 12K relative to the striker 40 is blocked by the first engagement portion 21. At the same time, the first engagement portion 21 is inserted to be positioned between the legs 40X, 40X (see FIG. 1) of the striker 40 so that the latch 20 engages with the striker 40.

Figure 5:
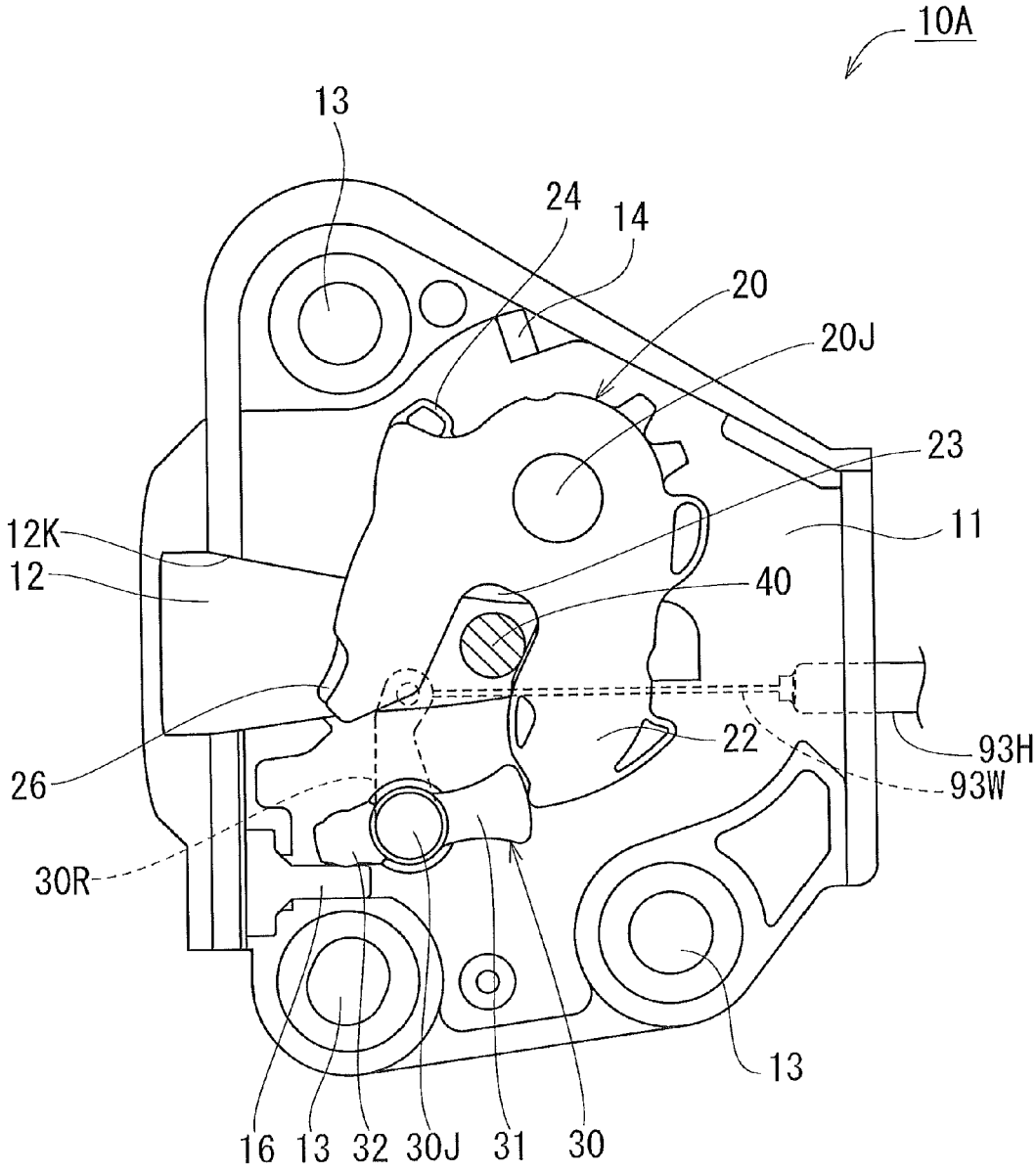
FIG. 5 is a front view of the closed door lock device in a fully latched state.
Figure 6:
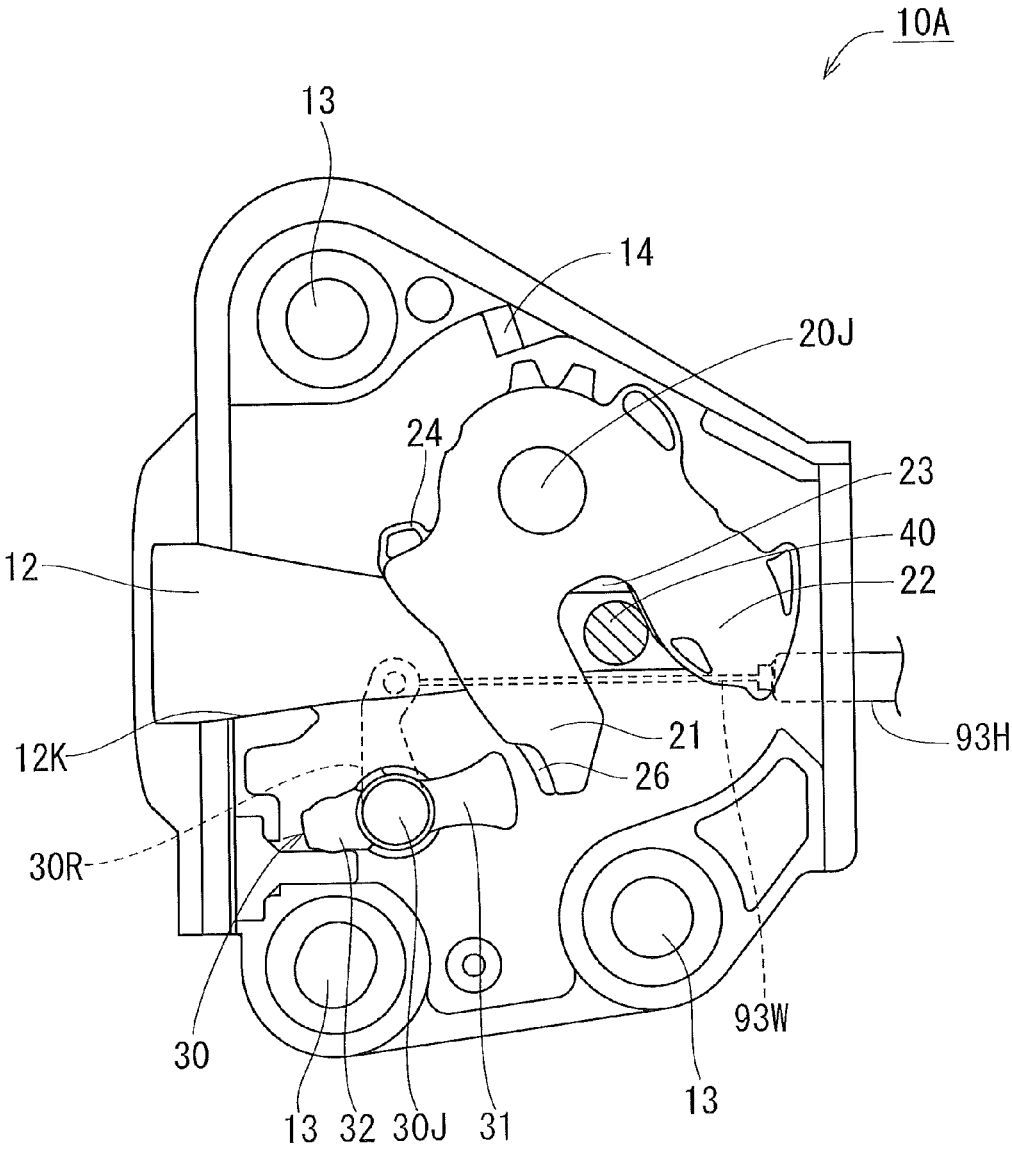
FIG. 6 is a front view of the closed door lock device in an over-latched state.

In a case where the slide door 90 is closed by a strong force, the slide door 90 is closed to a position where a soundproof member provided between the slide door 90 and the doorframe 99W is maximally squeezed. At this time, the latch 20 reaches an over-stroke position where the latch 20 is slightly separated from the pawl 30 by passing over the pawl 30 as illustrated in FIG. 6. Then, the slide door 90 is returned (i.e., moves in an opening direction) by means of an elastic force of the soundproof member to thereby slightly return the slide door 90 from the over-stroke position towards the unlatched position. At this time, as illustrated in FIG. 5, the first engagement portion 21 of the latch 20 and the latch rotation restricting piece 31 of the pawl 30 make contact with each other to thereby locate the latch 20 in a fully latched position. Specifically, a pawl contact portion 26 exposed from the resin layer is provided at a tip end of the first engagement portion 21. Metal constituting the pawl contact portion 26 and metal constituting the latch rotation restricting piece 31 make contact with each other, thereby restricting the rotation of the latch 20 in the unlock direction. Consequently, the slide door 90 is maintained in the fully closed state.

In a case where the slide door 90 is closed by a weak force and thus the latch 20 is prevented from reaching the over-stroke position or the fully latched position, and then the slide door 90 is returned (i.e., moves in the opening direction) by means of the elastic force of the soundproof member, the pawl 30 makes contact with a tip end of the second engagement portion 22 as illustrated in FIG. 4. The latch 20 is therefore located in a half-latched position, i.e., the slide door 90 is in a so-called half-latched state.

Next, a structure of the closure device 10B serving as a vehicle door latch device according to the present embodiment will be explained below.

Figure 7:
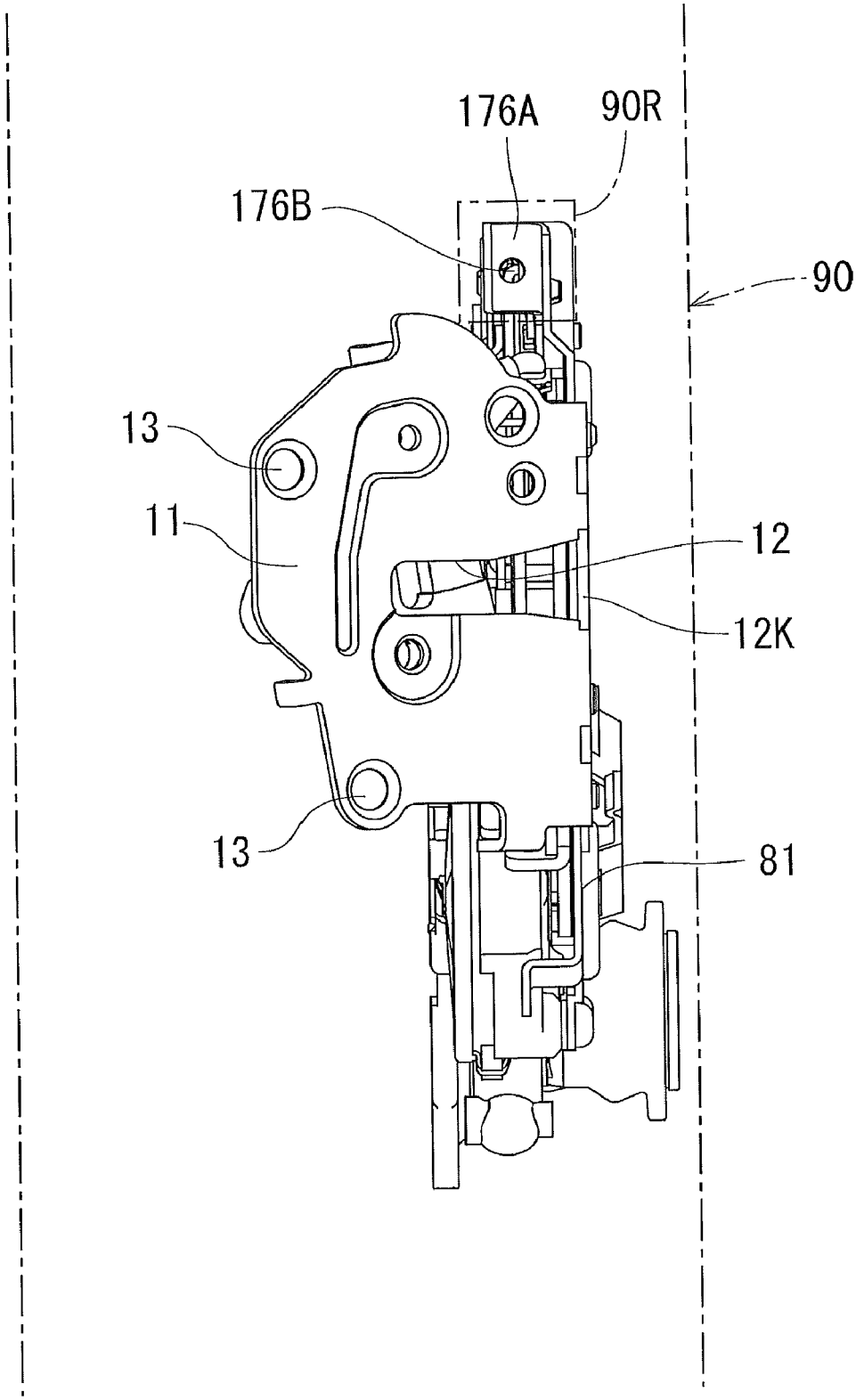
FIG. 7 is a side view of a closure device.
Figure 8:
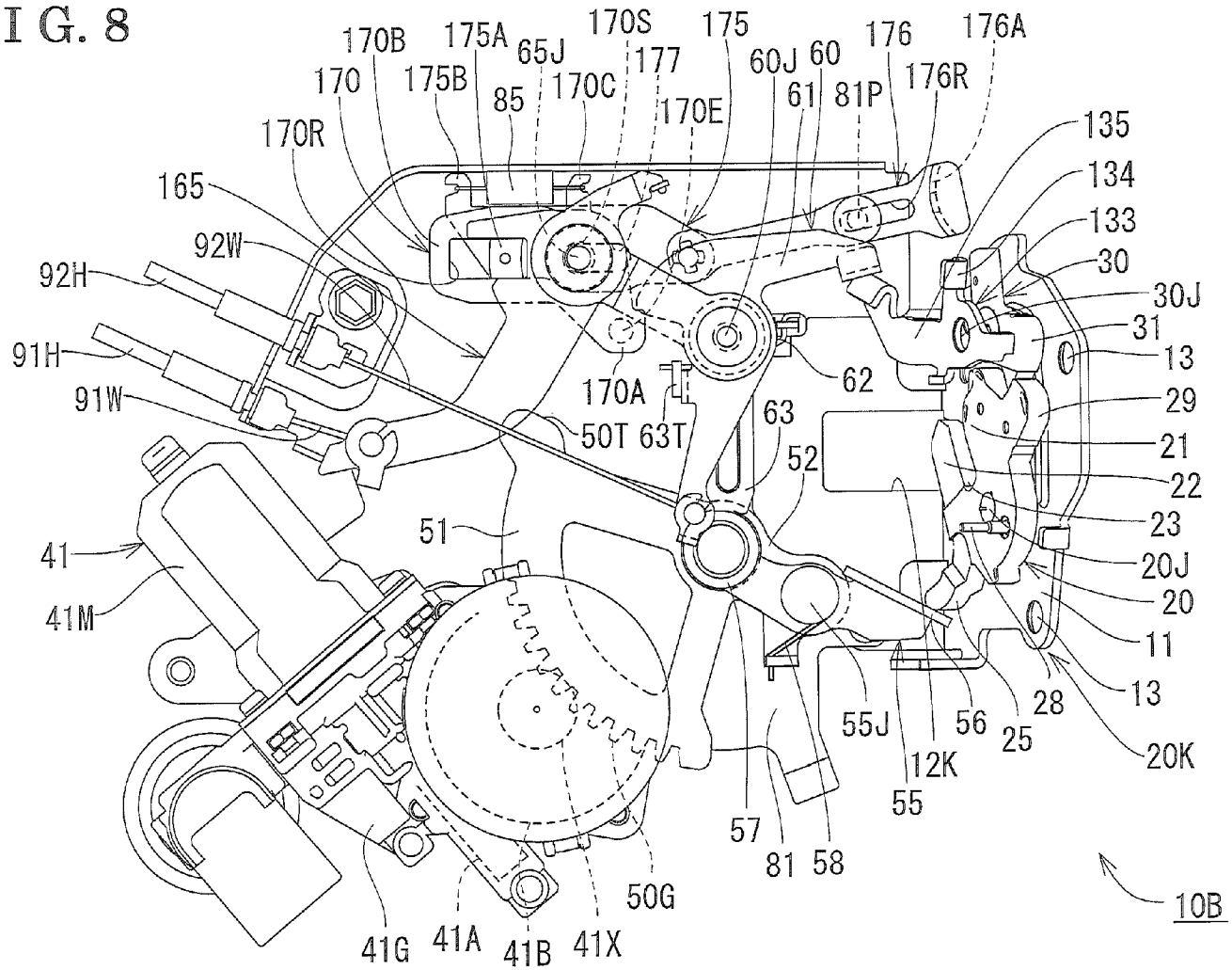
FIG. 8 is a front view of the closure device in a half-latched state.
Figure 9:
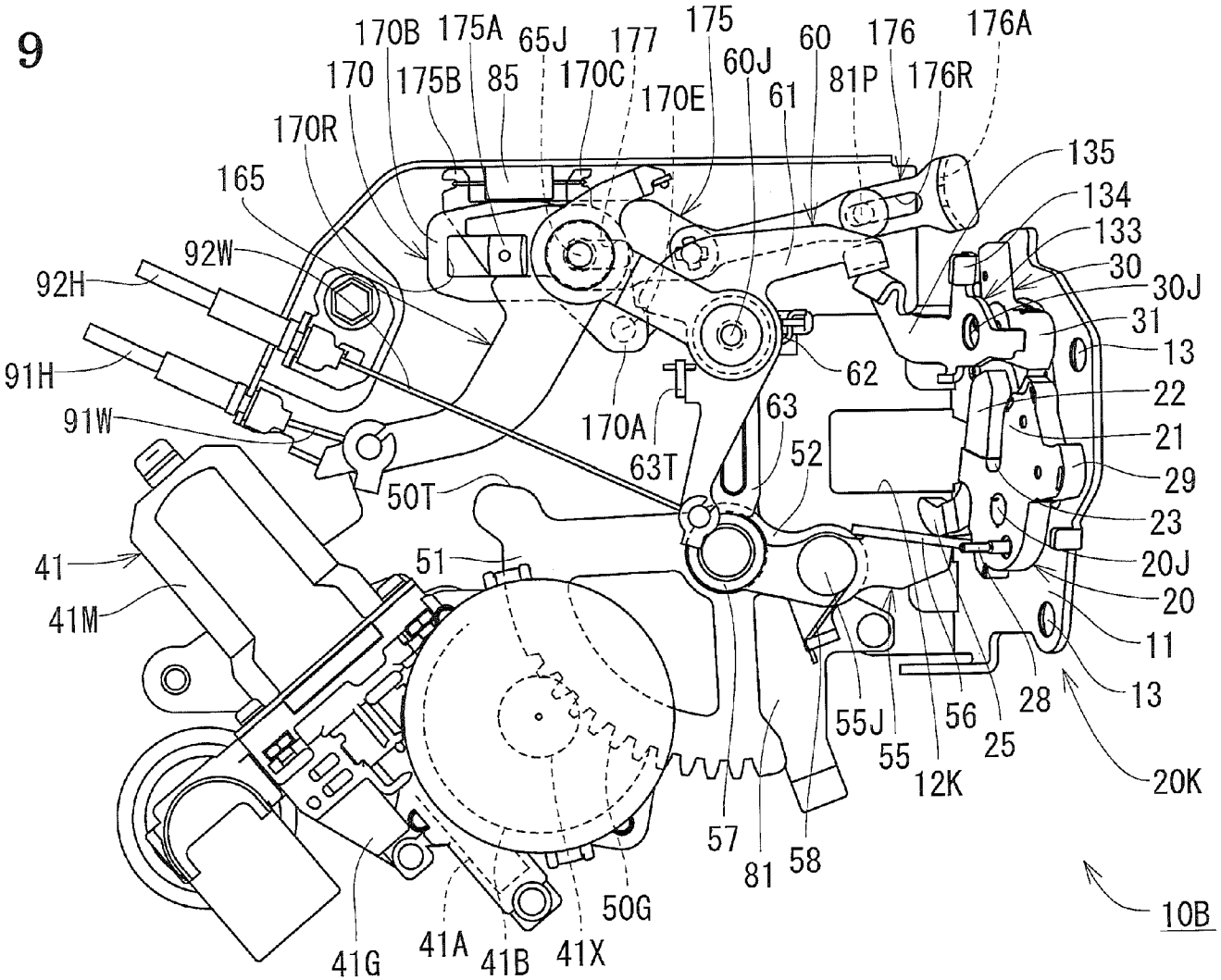
FIG. 9 is a front view of the closure device in a fully latched state.

The closure device 10B is illustrated in FIGS. 7 to 15. As illustrated in FIG. 8, the closure device 10B includes a latch and pawl mechanism 20K having the latch 20, the pawl 30, the striker receiving groove 12, and the like in the same way as the closed door lock device 10A. In the latch and pawl mechanism 20K, the closure device 10B is different from the closed door lock device 10A in that, for example, a rotational shaft 20J of the latch 20 is provided at a lower side of the striker receiving groove 12 (see FIG. 7) while the rotational shaft 30J of the pawl 30 is provided at an upper side of the striker receiving groove 12. In addition, a latch drive lever 25 is provided at the second engagement portion 22. Further, a half-latch engagement projection 29 and a position detection pin 28 are provided at the first engagement portion 21. In the following, the same structures between the closure device 10B and the closed door lock device 10A bear the same reference numerals and only different structures between the closure device 10B and the closed door lock device 10A will be explained.

As illustrated in FIGS. 7 and 8, the base 11 of the closure device 10B is obtained by sheet metal bent at an obtuse angle, resulting in a corner portion where the opening portion 12K is formed. A mechanism plate 81 is connected in an overlapping manner to an end portion on one side of the base 11 relative to the corner portion. The latch and pawl mechanism 20K is provided at an inner surface on the other side of the base 11 as illustrated in FIG. 8. The latch 20 of the latch and pawl mechanism 20K is covered by a latch and pawl cover.

As illustrated in FIG. 8, the latch 20 includes the latch drive lever 25, the half-latch engagement projection 29, and the position detection pin 28. The latch drive lever 25 and the half-latch engagement projection 29 are orthogonal to the rotational shaft 20J of the latch 20. In addition, the latch drive lever 25 and the half-latch engagement projection 29 extend in opposite directions to each other. In a state where the pawl 30 is in contact with the half-latch engagement projection 29 of the latch 20 and therefore the latch 20 is in the half-latched position, the latch drive lever 25 extends in obliquely downward direction. When the latch drive lever 25 is pressed upward in the aforementioned state by a seesaw-shaped rotary lever 55 (hereinafter referred to as a seesaw rotary lever 55) which will be explained later, the latch 20 rotates in the lock direction where the latch 20 further engages with the striker 40. Then, the latch 20 is shifted to the fully latched position where the tip end of the second engagement portion 22 is in contact with the pawl 30 (see FIG. 9). The position detection pin 28 is arranged at a lower side of the rotational shaft 20J, being in parallel therewith so as to extend in a direction away from the base 11. An end of the position detection pin 28 is connected to a latch position detection sensor by passing through the latch and pawl cover. The latch position detection sensor detects whether the latch 20 is in the half-latched position (see FIG. 8), the fully latched position (see FIG. 9), or the unlatched position (see FIG. 11).

The rotational shaft 30J of the pawl 30 extends in a direction away from the base 11. A tip end of the rotational shaft 30J penetrates through the latch and pawl cover. A pawl drive lever 133 extends laterally from the tip end of the rotational shaft 30J. The pawl drive lever 133 includes a stopper piece 134 and a pressed piece 135. The stopper piece 134 makes contact with a stopper provided at the latch and pawl cover to thereby locate the pawl 30 in a position where the pawl 30 restricts the rotation of the latch 20 (i.e., a latch engagement position). The pressed piece 135 can be pressed down by a pressing piece 61 of an open lever 60, which will be explained later. When the pressed piece 135 is pressed down, the latch rotation restricting piece 31 of the pawl 30 is shifted to the release position serving as a latch engagement release position where the latch rotation restricting piece 31 is away from the rotation range of the latch 20, thereby releasing the rotation restriction of the latch 20.

Components of a release power transmitting mechanism and a close power transmitting mechanism according to the present embodiment are attached to the mechanism plate 81. Specifically, an active lever 50 (see FIGS. 19 and 20) serving as an active rotary member is rotatably supported at a lower end portion of the mechanism plate 81. The active lever 50 includes a fan-shaped rotary plate 51 (hereinafter referred to as a fan rotary plate 51) on a side opposite to the latch and pawl mechanism 20K relative to a rotational shaft 50J of the active lever 50. A gear portion 50G is formed at an outer periphery of the fan rotary plate 51. In addition, the active lever 50 includes a rotation support projection 52 projecting towards the latch and pawl mechanism 20K from the rotational shaft 50J. The seesaw rotary lever 55 is rotatably supported by an end portion of the rotation support projection 52.

The seesaw rotary lever 55 has a seesaw structure in which rotating pieces extend on both sides relative to a rotational shaft 55J. The seesaw rotary lever 55 includes a pressing wall 56 that is bent from an upper edge in a direction opposite to a direction where the mechanism plate 81 is provided. The pressing wall 56 extends over a range from an upper position of the rotational shaft 55J to an edge of the seesaw rotary lever 55 facing the latch and pawl mechanism 20K. The pressing wall 56 is able to make contact with the latch drive lever 25 from a lower side thereof. In addition, the seesaw rotary lever 55 is biased by a torsion coil sprig 58 shown in FIG. 8 in a direction where the pressing wall 56 is separated from the latch drive lever 25.

A contact roller 57 is provided at an end portion of the seesaw rotary lever 55 on a side opposite to the latch and pawl mechanism 20K. A positioning lever 63 strikes the contact roller 57 from an upper side. The active lever 50, the seesaw rotary lever 55, and the positioning lever 63 constitute a second cancel structure according to the present embodiment. When the active lever 50 rotates in the counterclockwise direction in FIG. 8 while the contact roller 57 is positioned by the positioning lever 63, the rotational shaft 55J of the seesaw rotary lever 55 moves upward, so that the pressing wall 56 formed at the end portion of the seesaw rotary lever 55 presses the latch drive lever 25 upward. Such operation of the active lever 50 is called a close operation. When the positioning lever 63 moves to separate from the contact roller 57, the seesaw rotary lever 55 is rotatable relative to the active lever 50. Accordingly, the power transmission from the active lever 50 to the seesaw rotary lever 55 is interrupted. The pressing wall 56 of the seesaw rotary lever 55 is prevented from pressing the latch drive lever 25. The latch drive lever 25, the seesaw rotary lever 55, and the positioning lever 63 collectively serve as the aforementioned close power transmitting mechanism.

As illustrated in FIG. 8, an actuator 41 is provided on an opposite side to the latch and pawl mechanism 20K relative to the active lever 50. The actuator 41 includes a latch drive motor 41M serving as a motor and a speed reduction mechanism 41G. The speed reduction mechanism 41G includes a worm gear 41A and a worm wheel 41B. An output shaft of the latch driver motor 41M is connected to the worm gear 41A. A small gear 41X, which is integrally provided at the worm wheel 41B, engages with the gear portion 50G of the fan rotary plate 51. Accordingly, the active lever 50 is driven to rotate in both clockwise and counterclockwise directions by means of the latch drive motor 41M.

As illustrated in FIG. 8, the positioning lever 63 and the open lever 60 are supported by the mechanism plate 81 so as to be rotatable about a single rotational shaft 60J. Specifically, the positioning lever 63 and the open lever 60 are provided at an upper side of the rotational shaft 50J of the active lever 50. One end portion of an open cable 92W is connected to an end of a portion of the open lever 60 that extends downward from the rotational shaft 60J. The other end of the open cable 92W is connected to the remote control device 91 (see FIG. 16). An intermediate portion of the open cable 92W is covered by a cladding tube 92H.

The pressing piece 61 of the open lever 60 formed at an upper side of the rotational shaft 60J extends towards the pawl 30. When the open cable 92W is pulled towards the remote control device 91, the open lever 60 rotates, whereby the pressing piece 61 presses down the pawl drive lever 133 (specifically, the pressed piece 135). Thus, the pawl 30 is shifted to the release position so that the pawl 30 cancels the rotation restriction of the latch 20. Such operation of the active lever 50 is called a release operation. The open lever 60 is biased by a torsion coil spring 62 provided between the open lever 60 and the mechanism plate 81 in a direction where the pressing piece 61 is away from the pressed piece 135 (i.e., the counterclockwise direction in FIG. 8).

The positioning lever 63 is provided, overlapping the open lever 60. An interlocking contact piece 63T formed to project from a side edge of the positioning lever 63 faces the open lever 60 from one side. When the open lever 60 rotates because of the pulling of the open cable 92W towards the remote control device 91, the interlocking contact piece 63T is pressed by the open lever 60. Then, the positioning lever 63 rotates to separate from the contact roller 57. As a result, the power transmission from the active lever 50 to the seesaw rotary lever 55 is interrupted, which presents the latch drive lever 25 to be pressed upward by the pressing wall 56 of the seesaw rotary lever 55.

Figure 15A:
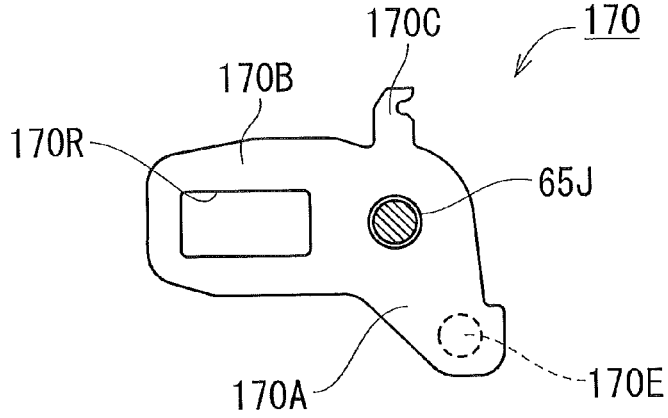
FIG. 15A is a front view of the release input lever.

A release input lever 170, a slide rotary lever 175, and a release lever 165 are supported in the vicinity of the open lever 60 so as to be rotatable about a single rotational shaft 65J. The release input lever 170, the slide rotary lever 175, and the release lever 165 serve as a first cancel mechanism. As illustrated in FIG. 15A, the release input lever 170 includes a first rotation piece 170A that extends downward from the rotational shaft 65J, and a second rotation piece 170B that extends transversely from the rotational shaft 65J. A contact boss 170E projects from an end portion of the first rotation piece 170A towards the mechanism plate 81. A projection engagement bore 170R having a horizontally long rectangular shape is formed at the second rotation piece 170B. The release input lever 170 includes a spring engagement hook 170C that projects upward. The open lever 60, the release input lever 170, the slide rotary lever 175, and the release lever 165 collectively serve as the aforementioned release power transmitting mechanism.

A press portion 50T formed at the active lever 50 makes contact with the contact boss 170E of the first rotation piece 170A when the active lever 50 rotates in the clockwise direction by the latch drive motor 41M. Then, the release input lever 170 rotates in the counterclockwise direction in FIG. 8 against a biasing force of a torsion spring 170S.

Figure 15B:
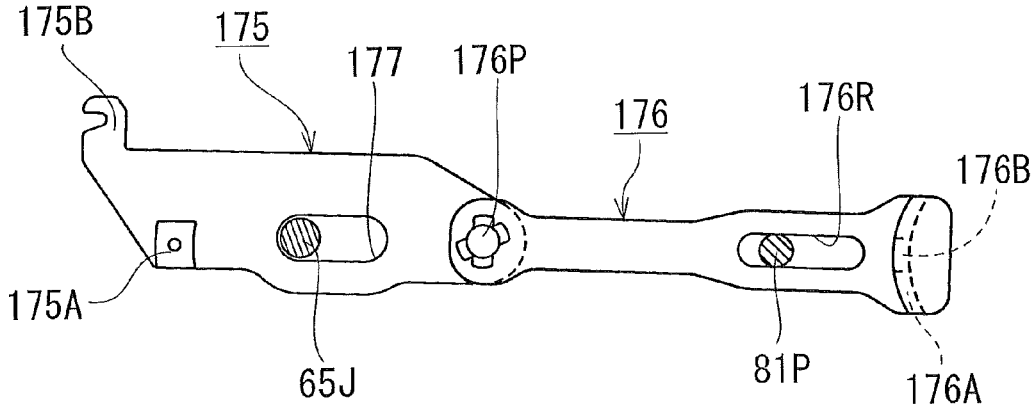
FIG. 15B is a front view of the slide rotary lever.

The slide rotary lever 175 is arranged between the release input lever 170 and the mechanism plate 81. The slide rotary lever 175 extends in a longitudinal direction of the second rotation piece 170B of the release input lever 170. As illustrated in FIG. 15B, an elongated bore 177 that extends in the longitudinal direction is formed at the slide rotary lever 175. The rotational shaft 65J penetrates through the elongated bore 177. In addition, a spring engagement hook 175B is formed to project at an end portion of the slide rotary lever 175. A spring 85 connects the spring engagement hook 175B of the slide rotary lever 175 and the spring engagement hook 175C of the release input lever 170 as shown in FIG. 8.

A connecting swing projection 175A projects from an end portion of the slide rotary lever 175 in a direction away from the mechanism plate 81. The connecting swing projection 175A is formed into a square column shape having a width (i.e., a vertical direction in FIG. 15B) substantially same as a width (i.e., a vertical direction in FIG. 15A) of the projection engagement bore 170R of the release input lever 170. The connecting swing projection 175A is also received within a projection receiving groove 165R formed at the release lever 165 while penetrating through the projection engagement bore 170R.

The slide rotary lever 175 is biased by the spring 85 so that the rotational shaft 65J is in contact with a front end (i.e., left side in FIG. 15B) of the elongated bore 177. The slide rotary lever 175 is restricted so as not to move in a direction perpendicular to an axial direction of the rotational shaft 65J. In addition, when an external force is applied to the longitudinal direction of the slide rotary lever 175, the slide rotary lever 175 is slidable against a biasing force of the spring 85.

A cancel operation lever 176 is connected to the slide rotary lever 175 so as to linearly move the slide rotary lever 175 from a power transmitting position to a power interrupting position. The cancel operation lever 176 is rotatably connected via a connection pin 176P to a base portion of the slide rotary lever 175 that is formed on an opposite side of the connecting swing projection 175A relative to the elongated bore 177. The cancel operation lever 176 extends substantially in parallel with the longitudinal direction of the slide rotary lever 175. A base portion (i.e., right side in FIG. 8) of the cancel operation lever 176 exposed, extending laterally from an edge of the mechanism plate 81 as illustrated in FIG. 8.

An elongated bore 176R is formed at the cancel operation lever 176 so as to extend in the longitudinal direction thereof. More specifically, the elongated bore 176R is formed at a portion closer to the base portion relative to a center portion in the longitudinal direction of the cancel operation lever 176. A pin 81P provided to project from the mechanism plate 81 penetrates through the elongated bore 176R. Consequently, the cancel operation lever 176 is linearly movable in the longitudinal direction and rotatable relative to the pin 81P.

A press operation piece 176A is provided at the base portion of the cancel operation lever 176. The press operation piece 176A is formed into a crank shape projecting in a direction away from the mechanism plate 81. The press operation piece 176A faces an emergency operation bore 90R (see FIG. 7) used for emergency and formed at a rear end wall of the slide door 90. A predetermined tool inserted through the emergency operation bore 90R is able to strike the press operation piece 176A. A wall portion of the press operation piece 176A perpendicular to the mechanism plate 81 is formed into a recess shape gently curved when viewed from the emergency operation bore 90R. An antislip recess portion 176B is formed at the cancel operation lever 176 so as to make concavo-convex engagement with an end portion of a tool when the tool has the sharp end portion.

Figure 15C:
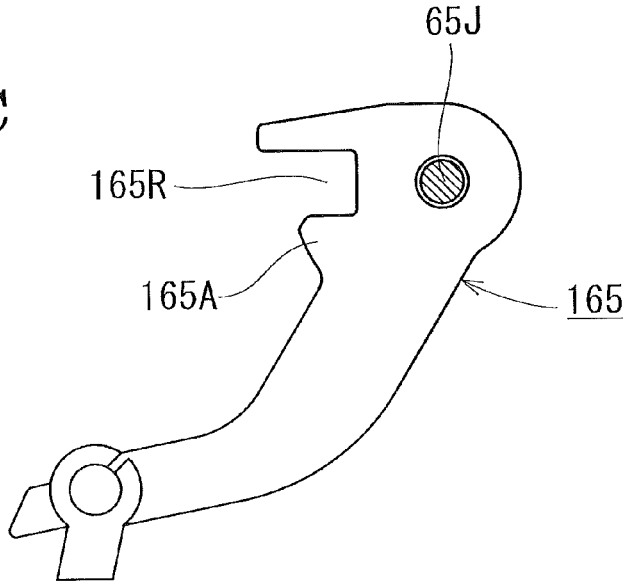
FIG. 15C is a front view of the release lever.

As illustrated in FIG. 15C, the release lever 165 extends obliquely downward from the rotational shaft 65J. One end of a release cable 91W is connected to a lower end portion of the release lever 165. The other end of the release cable 91W is connected to the remote control device 91. An intermediate portion of the release cable 91W is covered by a cladding tube 91H. The release lever 165 is biased in the clockwise direction in FIG. 8 because the release cable 91W is pulled by a first origin retention spring 98S provided at the remote control device 91.

A portion of the release lever 165 defined from a base end close to the rotational shaft 65J to an intermediate portion is formed into a fan shape having an increased width. The projection receiving groove 165R is formed at the fan-shaped portion. The projection receiving groove 165R is formed into a substantially U shape that opens in a direction perpendicular to the rotational shaft 65J. Specifically, the projection receiving groove 165R opens in an opposite direction from a direction where the latch and pawl mechanism 20K is provided. In a case where the slide rotary lever 175 is in the power transmitting position as illustrated in FIGS. 8 to 11, the connecting swing projection 175A is received within the projection receiving groove 165R. In a case where the slide rotary lever 175 is in the power interrupting position as illustrated in FIG. 12, the connecting swing projection 175A disengages from the projection receiving groove 165R, i.e., separates laterally thereof.

Figure 10:
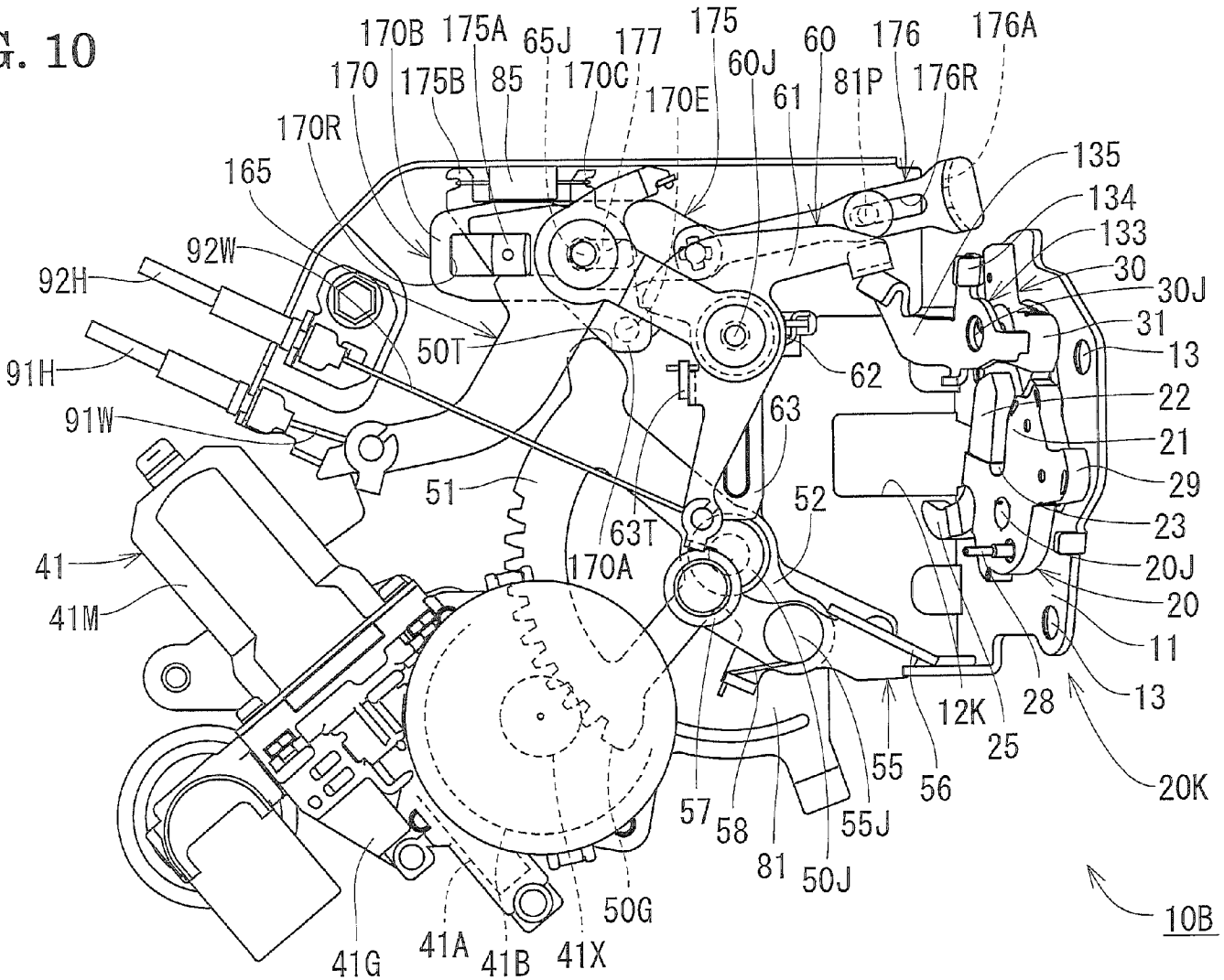
FIG. 10 is a front view of the closure device in a state immediately before an active lever makes contact with a release input lever.
Figure 11:
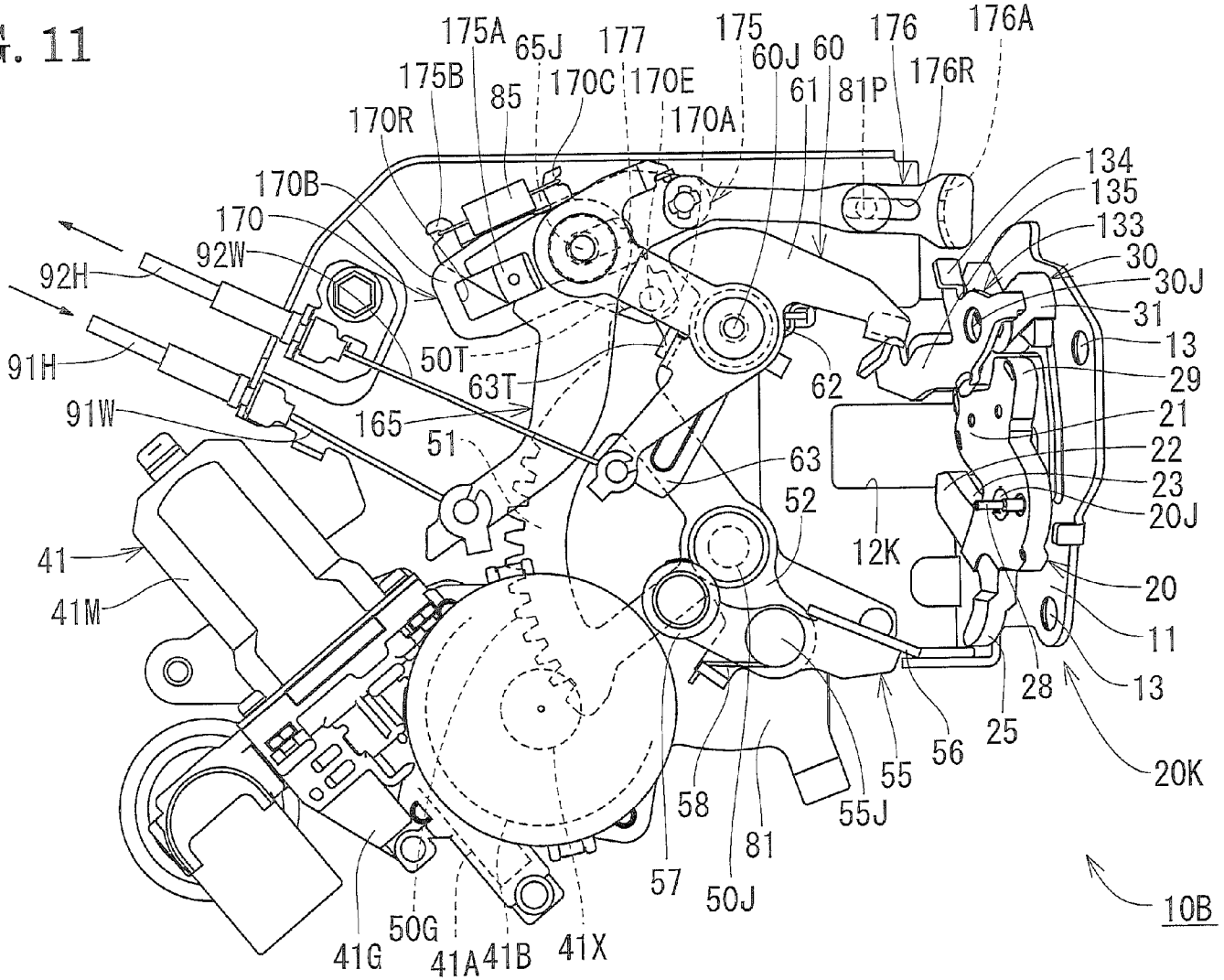
FIG. 11 is a front view of the closure device in a state where a pawl is shifted to a release position by means of power of a latch drive motor.

At this time, when the release input lever 170 rotates by receiving a rotation power from the active lever 50 in a state where the connecting swing projection 175A is received within the projection receiving groove 165R, the slide rotary lever 175 and the release lever 165 rotate together with the release input lever 170 as shown in FIGS. 10 and 11. Thus, the release cable 91W is pulled towards the closure device 10B from the remote control device 91.

Figure 12:
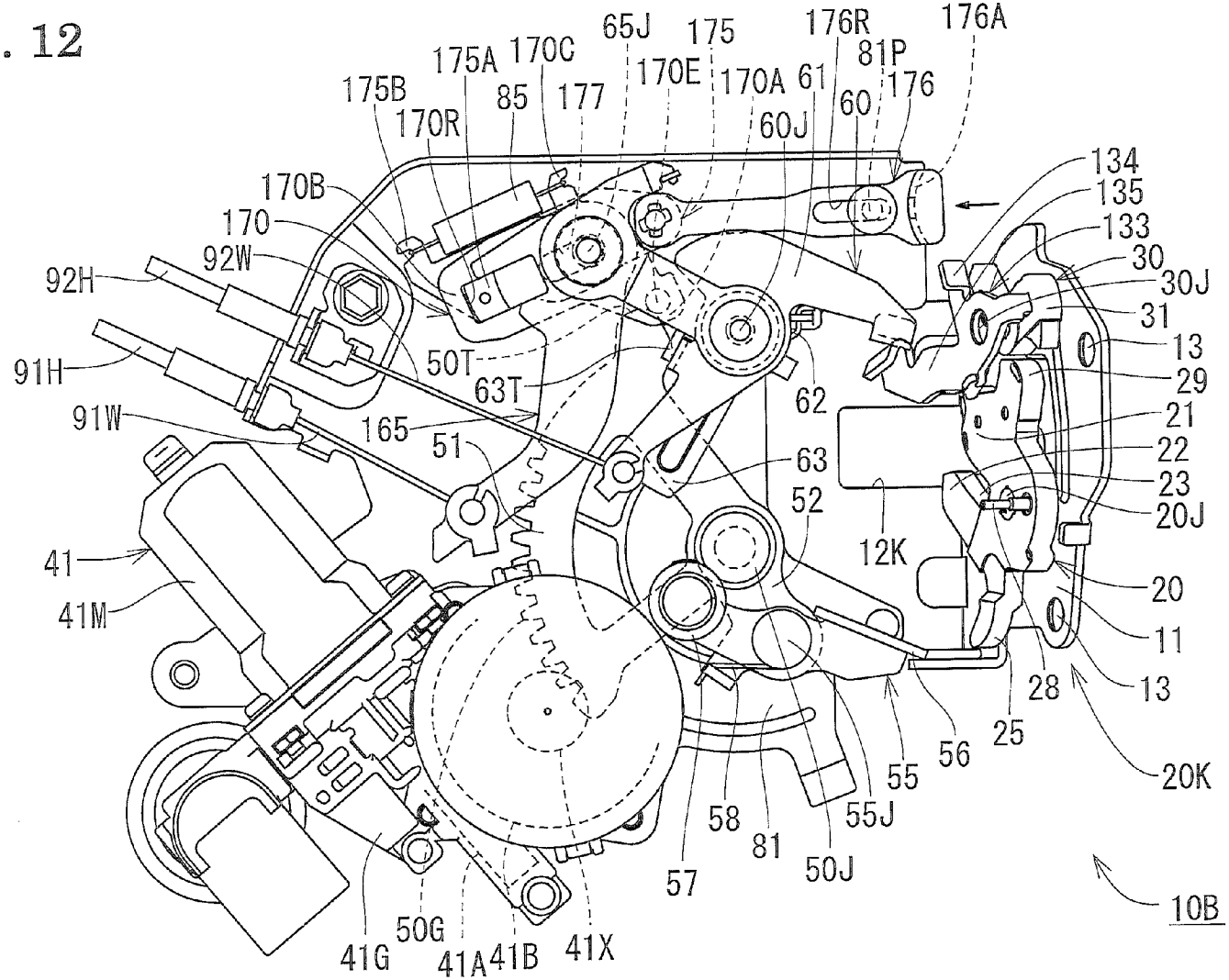
FIG. 12 is a front view of the closure device immediately after a slide rotary lever is shifted to a power interrupting position when the latch drive motor is abnormally stopped.
Figure 13:
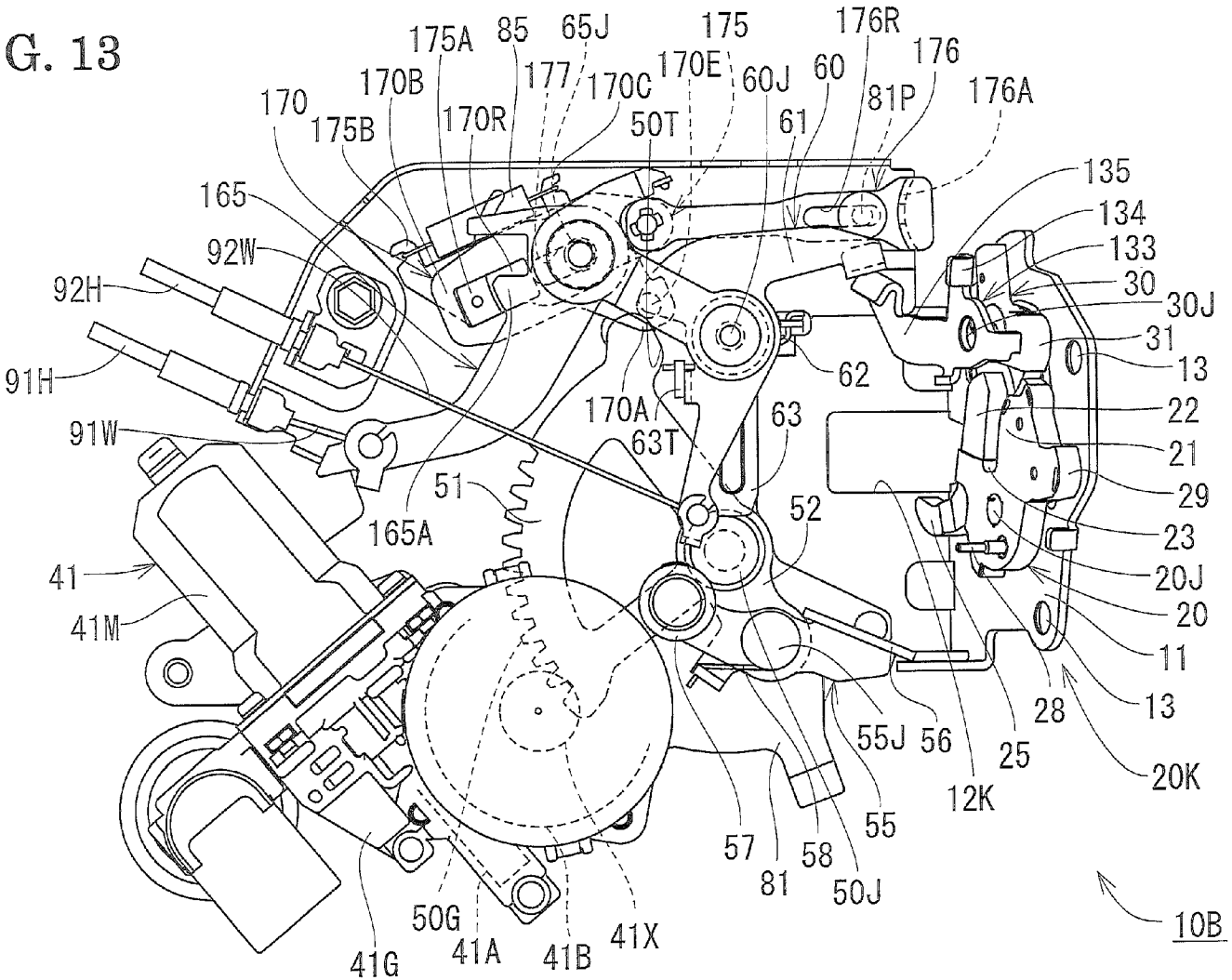
FIG. 13 is a front view of the closure device in which a release lever is returned to its original position because of the slide rotary lever in the power interrupting position.
Figure 14:
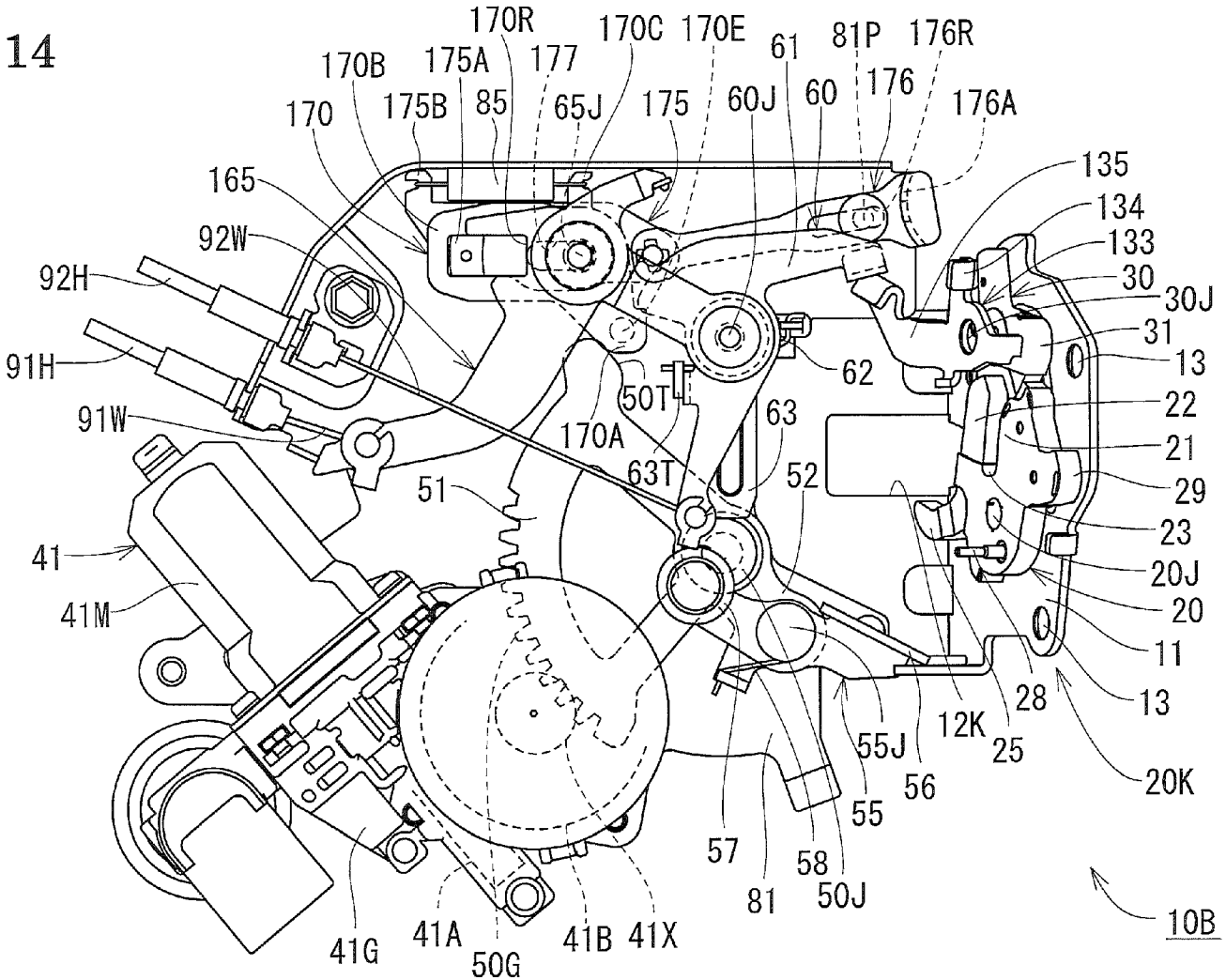
FIG. 14 is a front view of the closure device immediately before the slide rotary lever is returned to a power transmitting position because the latch drive motor recovers from the abnormally stopped state.

When the slide rotary lever 175 is shifted from the power transmitting position to the power interrupting position by the connecting swing projection 175A disengaging from the projection receiving groove 165R as shown in FIGS. 11 and 12, the release lever 165 is rotatable to the slide rotary lever 175 as illustrated in FIG. 13. That is, the power transmission between the connecting swing projection 175A and the release lever 165 is interrupted.

The fully opened door lock device 10C also includes the latch and pawl mechanism operating in the same way as that of the closed door lock device 10A. The pawl 30 of the fully opened door lock device 10C also includes the pawl drive lever 133 at the pawl 30. The pawl drive lever 133 and the remote control device 91 are connected by an open cable 94W (see FIG. 2).

Figure 16:
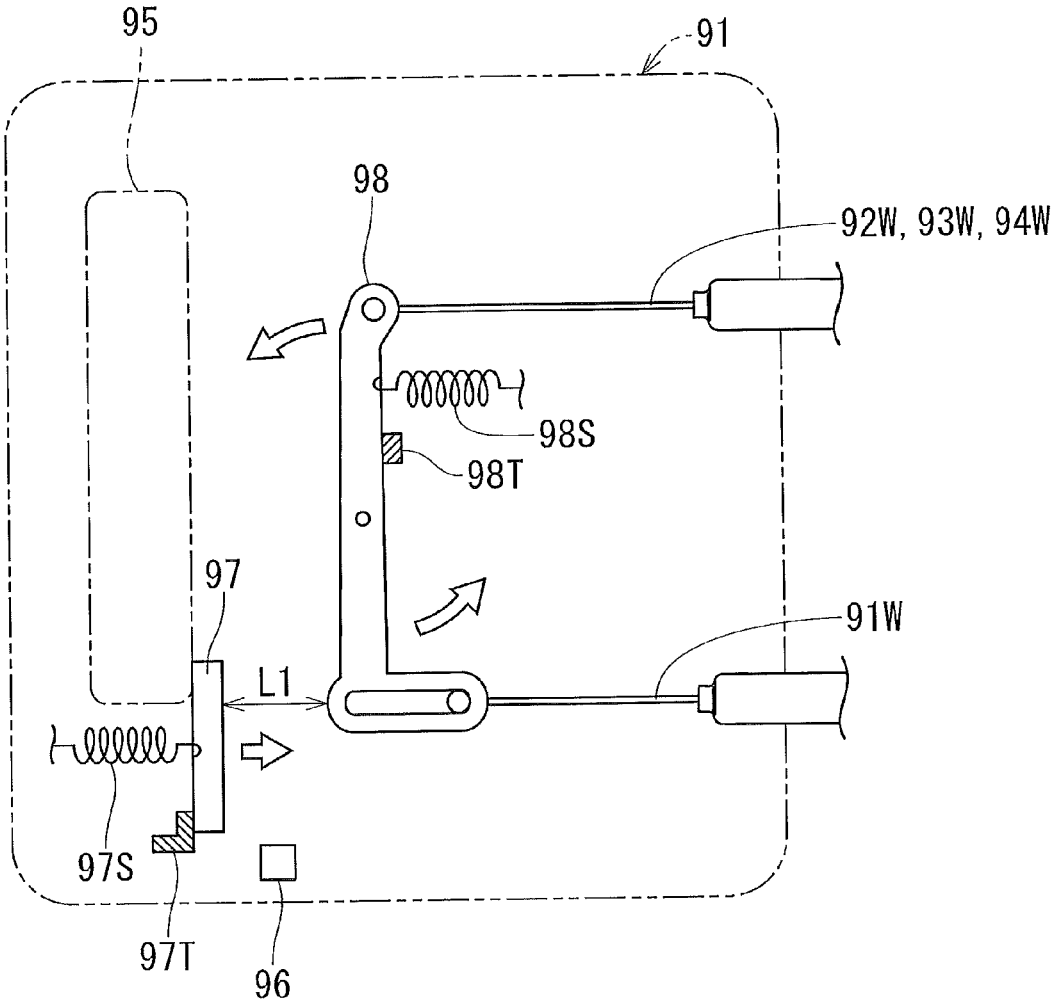
FIG. 16 is a schematic diagram of a remote control device.

As schematically illustrated in FIG. 16, the remote control device 91 includes a remote control rotation lever 98 of which one end is connected to the open cables 92W, 93W, and 94W. The remote control rotation lever 98 is biased and arranged at an origin position (i.e., a position illustrated in FIG. 16) by means of the first origin retention spring 98S and a stopper 98T. The other end of the remote control rotation lever 98, i.e., an end opposite to the connection portion with the open cables 92W, 93W, and 94W relative to a rotational center of the remote control rotation lever 98, is connected to the release cable 91W. When the latch drive motor 41M is driven so as to pull the release cable 91W towards the closure device 10B, the remote control rotation lever 98 rotates in a direction away from the origin position, i.e., in the counterclockwise direction in FIG. 16, thereby pulling the open cables 92W, 93W, and 94W towards the remote control device 91. As a result, the pawls 30 of the closed door lock device 10A, the closure device 10B, and the fully opened door lock device 10C are all shifted to the release positions, so that the restriction on rotation of all the latches 20 is released at once.

Handles 95 individually arranged at an inner surface and an outer surface of the slide door 90 are provided at the remote control device 91. Each of the handles 95 is biased and retained at an origin position by means of a second origin retention spring 97S and a stopper 97T. When the handle 95 is operated in a direction away from the origin position against a biasing force of the second origin retention spring 97S, a handle interlocking member 97 connected to the handle 95 moves from an origin position and passes through a predetermined independent movable area L1. The handle interlocking member 97 then makes contact with the remote control rotation lever 98. In such state, when the handle 95 moves further in a direction away from the origin position, the handle interlocking member 97 pushes the remote control rotation lever 98 to rotate. The remote control device 91 also includes a handle operation detection sensor 96 for detecting whether the handle interlocking member 97 moves and enters the independent movable area L1 from the origin position. A detection signal of the handle operation detection sensor 96, in addition to a detection signal of the latch position detection sensor, are received by an electronic control unit (ECU) provided at the vehicle body 99. The ECU drives the latch drive motor 41M based on the detection signals.

Next, effects obtained by the present embodiment having the aforementioned structure will be explained below. When the slide door 90 is closed, the latch 20 of the closed door lock device 10A and the latch 20 of the closure device 10B engage with the respective strikers 40 and rotate. At this time, when the slide door 90 is closed by a relatively strong force and thus the slide door 90 turns to the fully closed state, the latches 20 of the closed door lock device 10A and the closure device 10B rotate to the fully latched positions as illustrated in FIGS. 5 and 10, respectively. The latches 20 of the closed door lock device 10A and the closure device 10B engage with the respective pawls 30 (specifically, the latch rotation restricting pieces 31 of the pawls 30), thereby restricting or prohibiting the rotation of each of the latches 20 in the unlock direction. The slide door 90 is maintained in the fully closed state accordingly.

In a state where the slide door 90 is closed by a relatively weak force and thus the slide door 90 turns to the half-latched state, the latches 20 of the closed door lock device 10A and the closure device 10B rotate to the half-latched positions as illustrated in FIGS. 4 and 8, respectively. The latches 20 of the closed door lock device 10A and the closure device 10B engage with the respective pawls 30, thereby restricting or prohibiting the rotation of each of the latches 20 in the unlock direction. The slide door 90 is maintained in the half-latched state accordingly. Then, the latch position detection sensor of the closure device 10B detects that the latch 20 is in the half-latched position. The detection result of the latch position detection sensor is received by the ECU, which then drives the output shaft of the latch drive motor 41M provided at the closure device 10B to rotate in one direction, thereby rotating the active lever 50 in the counterclockwise direction in FIG. 8. At this time, the positioning lever 63 makes contact with the contact roller 57 and positions one end of the seesaw rotary lever 55. The rotational shaft 55J of the seesaw rotary lever 55 is lifted up by the active lever 50 so that the rotation power is transmitted from the active lever 50 to the seesaw rotary lever 55. The other end of the seesaw rotary lever 55 (specifically, an end portion of the pressing wall 56 provided at the seesaw rotary lever 55) pushes up the latch drive lever 25 of the latch 20. Consequently, the latch 20 is shifted from the half-latched position illustrated in FIG. 8 to the fully latched position illustrated in FIG. 9 to thereby shift the slide door 90 from the half-latched state to the fully closed state. The slide door 90 is maintained in the fully closed state accordingly.

In a case where the handle 95 is operated while the slide door 90 is in the process of shifting from the half-latched state to the fully closed state, the open cable 92W is pulled towards the remote control device 91. Then, the positioning lever 63 is separated from the contact roller 57 of the seesaw rotary lever 55. The power transmission from the active lever 50 to the seesaw rotary lever 55 is urgently interrupted, thereby canceling the shifting of the slide door 90 from the half-latched state to the fully closed state. In association with the operation of the handle 95, the open lever 60 also rotates. In addition, the pressing piece 61 of the open lever 60 presses down the pawl drive lever 133 of the pawl 30. Thus, even when the pawl 30 of the closure device 10B engages with the latch 20, the pawl 30 moves to the release position. Further, because the open cable 93W is also pulled towards the remote control device 91 by the operation of the handle 95, the pawl 30 of the closed door lock device 10A also moves to the release position. The slide door 90 is opened accordingly.

When the slide door 90 turns to the fully closed state, the soundproof member provided between the slide door 90 and the doorframe 99W is squeezed. The resulting reaction force generated by the squeezed soundproof member causes the pawls 30 of the closed door lock device 10A and the closure device 10B to frictionally engage with the respective latches 20. On the other hand, in order to open the slide door 90, the pawls 30 of the closed door lock device 10A and the closure device 10B are required to move to the respective release positions against the frictional resistance between the pawls 30 and the latches 20. At this time, a strong force is required for a simple manual operation to move both the pawls 30 to the release positions. However, according to the present embodiment, when the handle 95 is operated, the handle operation detection sensor 96 detects the operation of the handle 95 before the frictional resistance between the pawl 30 and the latch 20 is applied to the handle 95. The ECU that receives the detection result of the handle operation detection sensor 96 drives the output shaft of the latch drive motor 41M to rotate in the other direction.

Afterwards, the active lever 50 is driven to rotate in the clockwise direction in FIG. 10, which causes the release input lever 170, the slide rotary lever 175, and the release lever 165 to rotate in the counterclockwise direction. Then, as shown in FIGS. 10 and 11, the release lever 165 pulls the release cable 91W towards the closure device 10B. The remote control rotation lever 98 of the remote control device 91 rotates, thereby pulling the open cables 92W and 93W towards the remote control device 91. The pawls 30 of the closed door lock device 10A and the closure device 10B are shifted to the release positions and therefore the slide door 90 is easily opened.

When the slide door 90 is in the fully open state, the latch 20 and the striker 40 of the fully opened door lock device 10C engage with each other so that the pawl 30 and the latch 20 frictionally engage with each other. In this case, the operation of the handle 95 also causes the open cable 94W to be pulled towards the remote control device 91, thereby moving the pawl 30 of the fully opened door lock device 10C to the release position by means of the latch drive motor 41M. The slide door 90 is easily closed accordingly.

In a case where the latch drive motor 41M, the release input lever 170, the slide rotary lever 175, and the release lever 165 are abnormally or irregularly stopped in a state where the release cable 91W is pulled towards the closure device 10B from the remote control device 91 as illustrated in FIG. 11, the ECU detects such abnormal stop based on a state of power supply to the latch drive motor 41M, and the like. Then, for example, a warning light provided at a driver seat is turned on. In such state, the open lever 60 presses down the pressed piece 135 of the pawl drive lever 133 and thus the pawl 30 is prevented from returning from the release position. As a result, it is impossible to maintain the latch 20 from engaging the striker 40. That is, the slide door 90 is prevented from being fully closed. The vehicle itself can be driven but in practice the driving of the vehicle is dangerous because the slide door 90 cannot be closed.

In the aforementioned state, a driver can change the position of the slide rotary lever 175 to the power transmission interrupting position. That is, by inserting a predetermined tool such as a key of the vehicle and a screw driver through the emergency operation bore 90R provided at the rear end wall of the slide door 90 to push down the cancel operation lever 176. Then, the slide rotary lever 175 linearly moves via the engagement between the elongated bore 177 and the rotational shaft 65J. The connecting swing projection 175A disengages from the projection receiving groove 165R. As a result, the connection between the slide rotary lever 175 and the release lever 165 is released (see FIG. 12). The power transmission between the connecting swing projection 175A and the release lever 165 is interrupted and the release lever 165 is rotatable to the slide rotary lever 175. The warning light provided at the driver seat is turned off when it is detected that the slide rotary lever 175 is operated to an appropriate position. When the connecting swing projection 175A is pushed out of the projection receiving groove 165R to disengage therefrom, the remote control rotation lever 98 is returned to the origin position (i.e., the position illustrated in FIG. 16) by means of the first origin retention spring 98S. The release cable 91W is pulled towards the remote control device 91. As a result, as illustrated in FIG. 13, the release lever 165 rotates independently relative to the slide rotary lever 175 to return to an original position. When the release lever 165 rotates, a projection movement restricting portion 165A of the release lever 165 faces the connecting swing projection 175A on a side where the rotational shaft 65J is provided. The connecting swing projection 175A is restricted to approach the rotational shaft 65J. That is, the slide rotary lever 175 is maintained in the power transmission interrupting position.

Consequently, even when the latch drive motor 41M is abnormally stopped, the respective pawls 30 of the closed door lock device 10A, the closure device 10B, and the fully opened door lock device 10C are returned from the release positions to positions to engage with the respective latches 20. The slide door is maintained in the closed state accordingly.

Further, when the latch drive motor 41M recovers from the abnormally stopped state and the active lever 50 rotates in a direction away from the release input lever 170 (contact boss 170E) in a state where the slide rotary lever 175 is in the power transmission interrupting position and only the release lever 165 is returned to its original position (see FIG. 13), the release input lever 170 and the slide rotary lever 175 are returned to their original positions, respectively, by means of a biasing force of the torsion spring 170S (see FIG. 8). When the projection engagement bore 170R of the release input lever 170 and the projection receiving groove 165R of the release lever 165 overlap and match each other, the connecting swing projection 175A of the slide rotary lever 175 is again received within the projection receiving groove 165R of the release lever 165 by means of the biasing force of the spring 85. That is, the slide rotary lever 175 is automatically returned to the power transmitting position, and the cancel operation lever 176 is pushed back towards the emergency operation bore 90R of the slide door 90 (see FIG. 10).

Figure 19A:
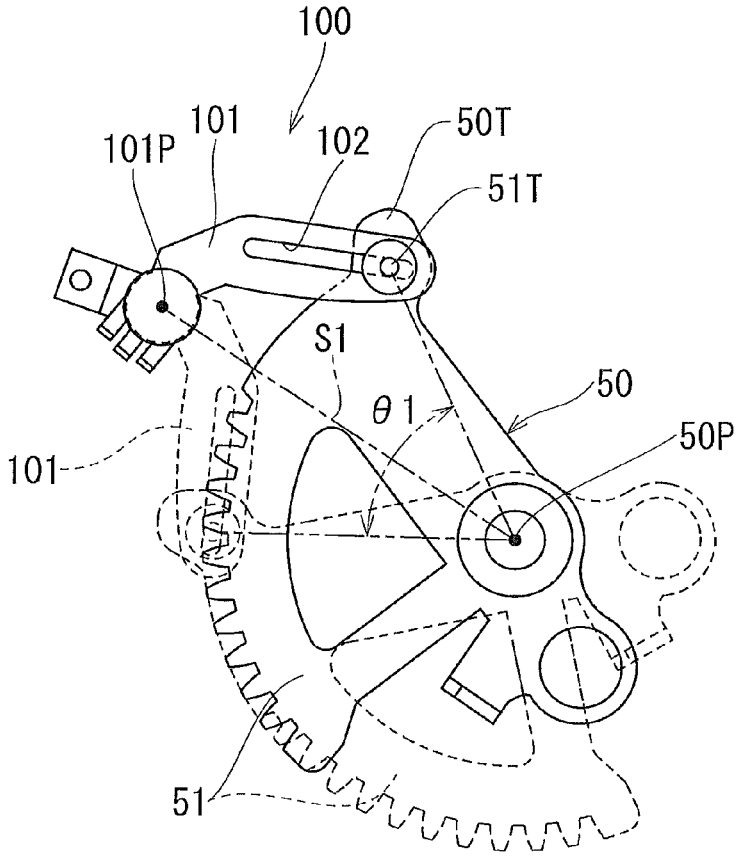
FIG. 19A is a front view of an active lever and an input lever in a release completion position.
Figure 20A:
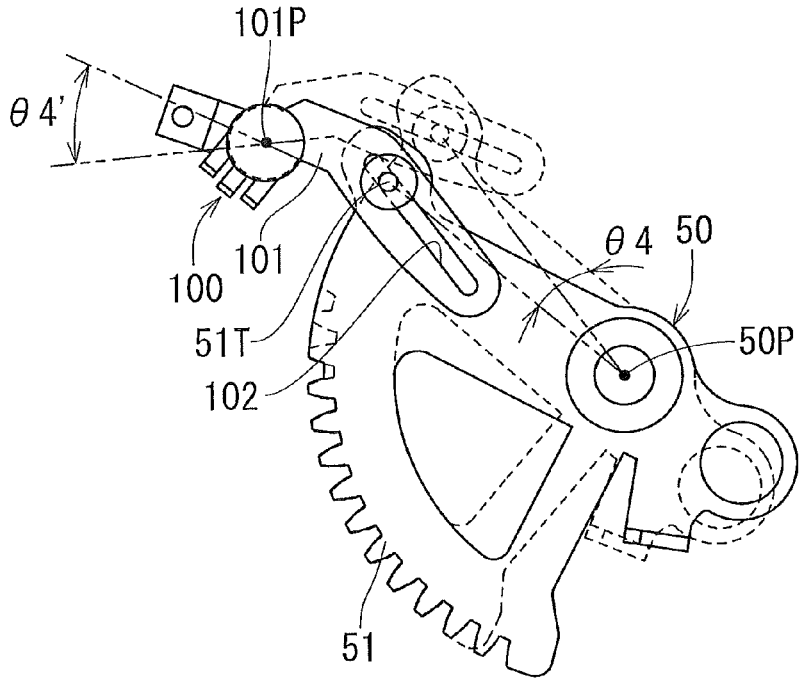
FIG. 20A is a front view of the active lever and the input lever in a close member contact position.

The active lever 50 driven by the latch drive motor 41M is configured to rotate in a reciprocating manner within the rotation range that is specified beforehand as mentioned above. In a normal state where neither the release operation nor the close operation is performed, the active lever 50 is arranged in a standby area defined within the rotation range. In FIG. 19A, the active lever 50 arranged in one end position of the rotation range is shown by a solid line while the active lever 50 arranged in the other end position of the rotation range is shown by a dotted line. In FIG. 20A, the active lever 50 arranged in one end position of the standby area is shown by a solid line while the active lever 50 arranged in the other end position of the standby area is shown by a dotted line.

Figure 19B:
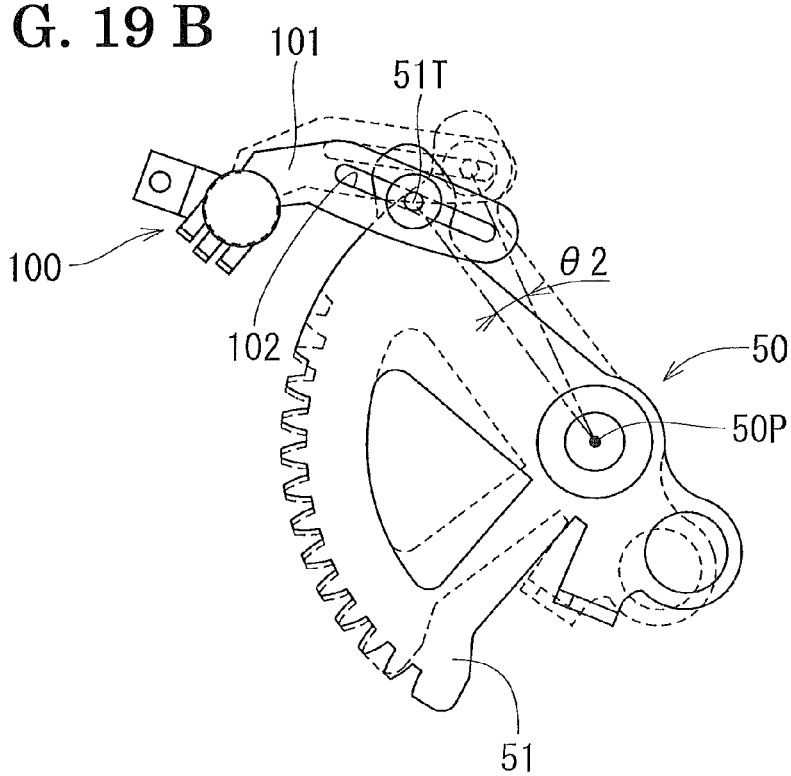
FIG. 19B is a front view of the active lever and the input lever in a release member contact position.

An area on a first side of the standby area within the rotation range, i.e., an area from a release member contact position of the active lever 50 as illustrated in a solid line in FIG. 19B to a release completion position as illustrated in the solid line in FIG. 19A is a release operation area where the pawl 30 is shifted from the latch engagement position to the latch engagement release position. In the release member contact position, the fan rotary plate 51 of the active lever 50 is in contact with the release input lever 170. The release completion position is achieved by the active lever 50 moving by a predetermined release operation angle θ2 from the release member contact position. The release completion position is equal to the one end position of the rotation range. In FIG. 19B, the active lever 50 arranged in both end positions of the release operation area is shown by the solid line and a dotted line.

Figure 20B:
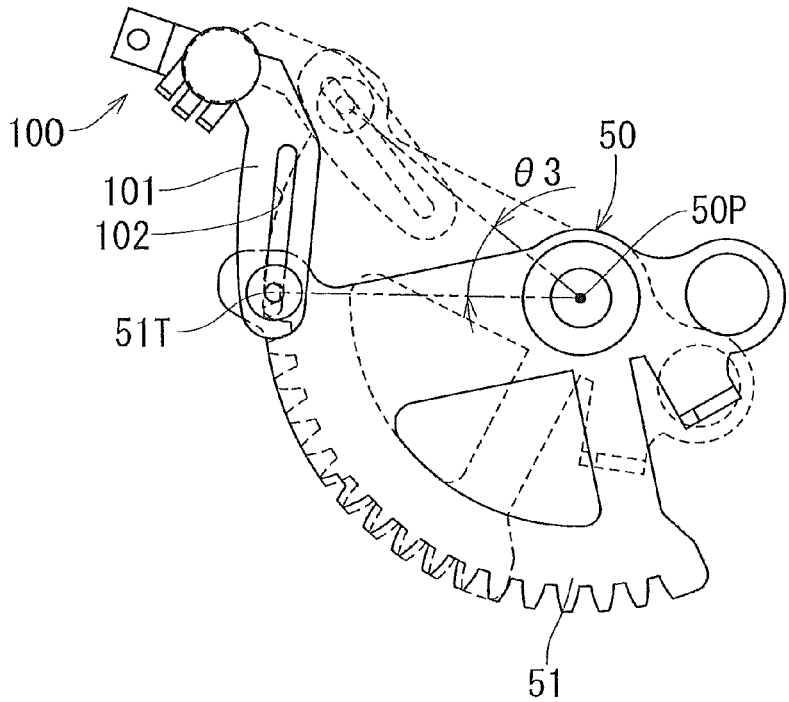
FIG. 20B is a front view of the active lever and the input lever in a close completion position.

An area on a second side of the standby area within the rotation range, i.e., an area from a close member contact position as illustrated in the solid line in FIG. 20A to a close completion position as illustrated in a solid line in FIG. 20B is a close operation area where the latch 20 is shifted from the half-latched position to the fully latched position. In the close member contact position, the seesaw rotary lever 55 is in contact with the latch 20 (specifically, the latch drive lever 25) in the half-latched position. The close completion position is achieved by the active lever 50 moving by a predetermined close operation angle θ3 from the close member contact position. The close completion position is equal to the other end position of the rotation range. In FIG. 20B, the active lever 50 arranged in both end positions of the close operation area are shown by the solid line and the dotted line.

Accordingly, the standby area is defined between the release member contact position as illustrated by the dotted line in FIG. 20A and the close member contact position as illustrated by the solid line in FIG. 20A. The release member contact position serves as a close member maximum separation position of the active rotary member. The close member contact position serves as a release member maximum separation position of the active rotary member.

The rotation range of the active lever 50, i.e., an angle θ1 (see FIG. 19A) formed between the release completion position and the close completion position is specified to be 53.3 degrees, for example. The release operation angle θ2 (see FIG. 19B) is specified to be 12.2 degrees, for example. The close operation angle θ3 (see FIG. 20B) is specified to be 38.1 degrees, for example. An angle of the standby area (i.e., an inoperative angle θ4 in FIG. 20A) is specified to be 13 degrees, for example.

Figure 17:
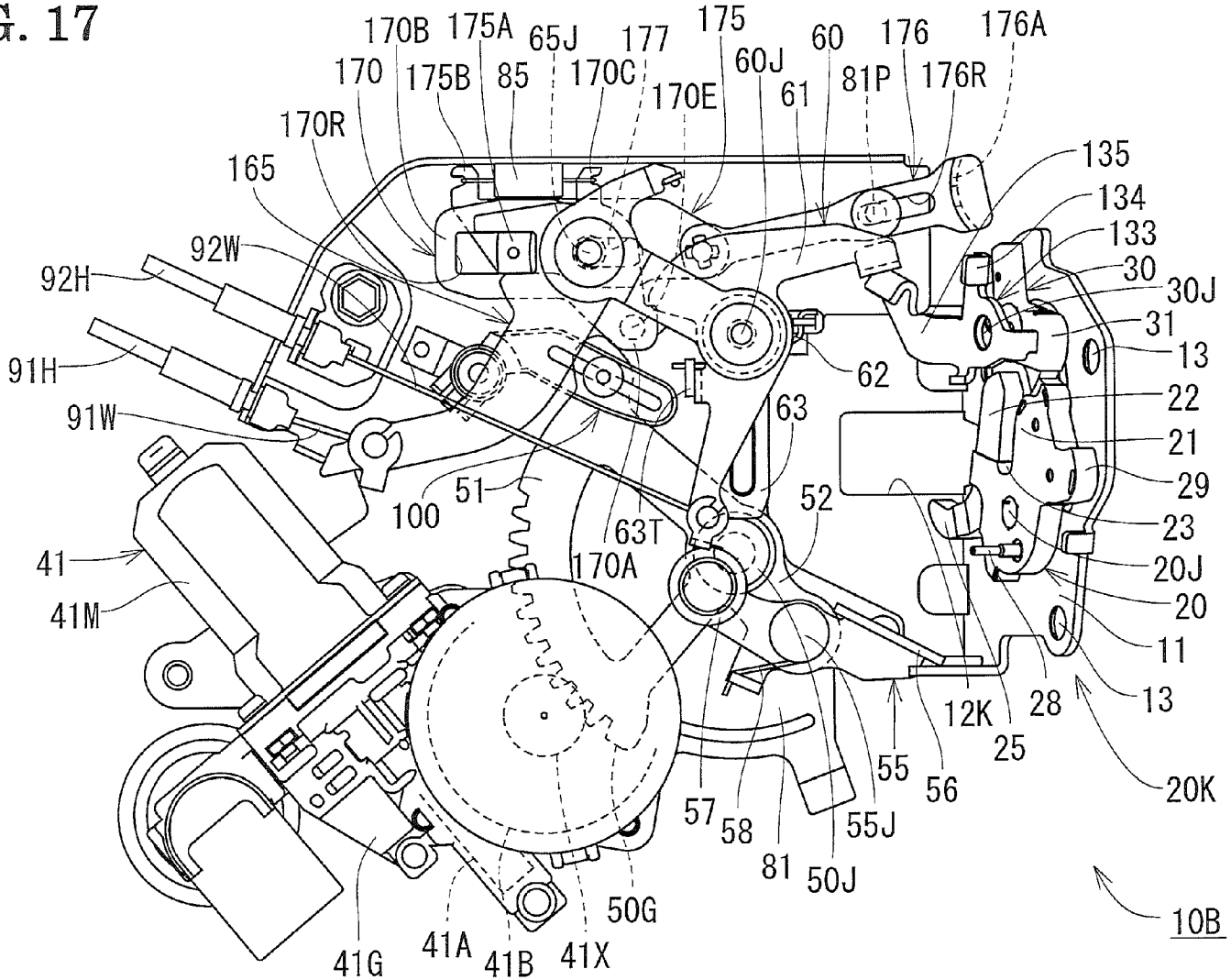
FIG. 17 is a front view of the closure device.

That is, the standby area is specified within the rotation range of the active lever 50 on one side close to the release completion position relative to a center position of the rotation range. In order to detect whether or not the active lever 50 is arranged within the standby area, the closure device 10B includes a rotary lever switch 100 serving as a standby state detecting device as illustrated in FIG. 17. In FIGS. 8 through 14, the lever switch 100 is omitted as a matter of convenience.

Figure 18:
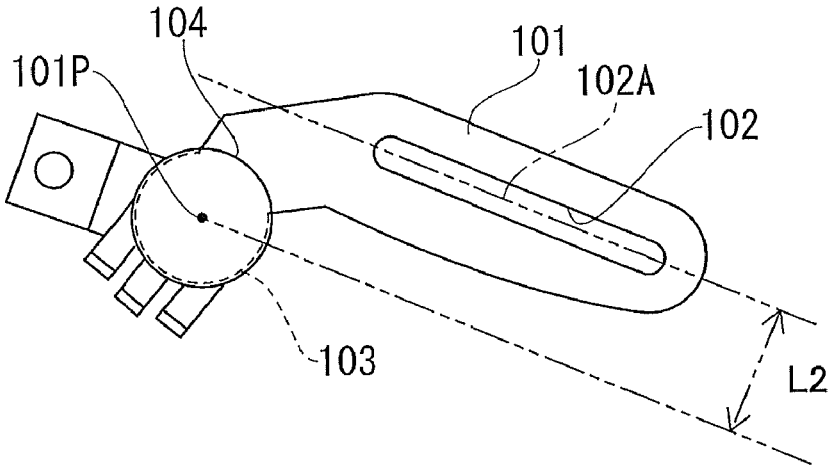
FIG. 18 is a front view of a lever switch.

The lever switch 100 is fixed to the mechanism plate 81. The lever switch 100 includes an input lever 101 that is rotatable. As illustrated in FIG. 18, a rotor 103 is integrally provided at a base portion of the input lever 101. The rotor 103 is rotatably accommodated within a cylindrically-shaped switch housing 104 fixed to the mechanism plate 81. The rotor 103 rotates relative to the switch housing 104 along with the rotation of the input lever 101. Multiple fixed contacts are arranged inside of the switch housing 104 along a circumferential direction thereof. The rotor 103 includes a moving contact that makes a slidable contact with the fixed contacts. The fixed contacts are arranged so as to make contact with the moving contact of the input lever 101 when the active lever 50 approaches either end position of the standby area, i.e., immediately before the active lever 50 enters the standby area. The moving contact and the fixed contacts are electrically connected to an electronic control unit (ECU) provided at the vehicle body 99 by means of multiple cables that extend to an outside of the switch housing 104. Accordingly, the rotational position of the input lever 101 that rotates in association with the active lever 50 (to be explained later) is received by the ECU so as to detect via the rotational position of the input lever 101 whether or not the active lever 50 is arranged within the standby area.

The input lever 101 is bent at a center between the base portion and a tip end portion. An elongated cam groove 102 is formed at a portion close to the tip end portion relative to the center. A rotational center 101P of the input lever 101 is arranged on a bisector of the angle θ1 of the rotation range of the active lever 50 (see FIG. 19A). A distance between the rotational center 101P of the input lever 101 and a rotational center 50P of the active lever 50 is specified to be 72 mm, for example.

The input lever 101 is attached, overlapping the fan rotary plate 51 of the active lever 50. A cam projection 51T projecting towards the input lever 101 is provided at a corner (i.e., a press portion 50T) of the fan rotary plate 51. The cam projection 51T engages with the cam groove 102 of the input lever 101 so as to be rotatable and linearly movable.

A minimum distance between the cam projection 51T and the rotational center 101P of the input lever 101 is shorter than a rotation radius of the cam projection 51T. For example, the rotation radius of the cam projection 51T is 51 mm, and the minimum distance between the cam projection 51T and the input lever 101 is 21 mm.

The cam groove 102 formed at the input lever 101 extends linearly. An extended line of a long axis 102A of the cam groove 102 is prevented from passing through the rotational center 101P of the input lever 101. That is, the rotational center 101P of the input lever 101 is arranged in an offset position by a predetermined distance L2 (for example, 13 mm) in a direction perpendicular to the long axis 102A of the cam groove 102. That is, the long axis 102A of the cam groove 102 is configured to be in parallel with a reference line S1 (see FIG. 19A) connecting the rotational center 101P of the input lever 101 and the rotational center 50P of the active lever 50 at a position away from the reference line S1. In such parallel state between the reference line S1 and the long axis 102A, the distance L2 is defined therebetween. Further, the cam groove 102 is configured to be in parallel with the reference line S1 when the active lever 50 is arranged in a position close to the release completion position relative to the center position of the rotation range, specifically, when the active lever 50 is positioned within the standby area (see FIG. 20A). Therefore, when the active lever 50 is arranged in the center position of the rotation range (i.e., the cam projection 51T is positioned on the reference line S1), the cam groove 102 is not in parallel with the reference line S1. The cam groove 102 intersects with the reference line S1 at an angle.

The active lever 50 and the input lever 101 are rotatable in conjunction with each other because of the engagement between the cam projection 5T and the cam groove 102. In the case of performing the release operation, the active lever 50 rotates in the clockwise direction in FIG. 19B from the standby area to enter the release operation area. At this time, the input lever 101 rotates in the counterclockwise direction. On the other hand, in the case of performing the close operation, the active lever 50 rotates in the counterclockwise direction in FIG. 20A from the standby area so as to enter the close operation area. At this time, as illustrated in FIG. 20B, the input lever 101 rotates in the clockwise direction.

While the active lever 50 rotates between the both ends of the rotation range (i.e., the release completion position and the close completion position), the cam projection 51T moves in a reciprocating manner within the cam groove 102 by approaching from one end portion of the cam groove 102 that is positioned away from the rotational center 101P of the input lever 101 to the other end portion that is positioned close to the rotational center 101P, and again approaching the one end portion.

According to the aforementioned embodiment, the standby area is provided within the rotation range of the active lever 50 on the side close to the release completion position relative to the center position. In connection with this, the cam groove 102 formed at the input lever 101 of the lever switch 100 is configured to be in parallel with the reference line S1 when the cam groove 102 is positioned away from the reference line S1. While the active lever 50 is positioned within the standby area, the reference line S1 and the cam groove 102 are in parallel with each other. That is, while the active lever 50 is positioned within the standby area, the rotational angle of the input lever 101 per unit rotation angle of the active lever 50 is maximized. Thus, as compared to a case where the cam groove 102 extends in parallel with the reference line S1 in a state where the cam groove 102 overlaps the reference line S1 when the active lever 50 is arranged at the center position of the rotation range, the rotation angle of the input lever 101 while the active lever 50 moves from the one end to the other end of the standby area is increased. Accordingly, it is detectable whether or not the active lever 50 is positioned within the standby area even with less accuracy of the standby state detecting device, thereby decreasing a cost for the standby state detecting device. The present embodiment will be explained in detail below by comparing with comparison examples.

Structures, dimensions, and positional relationships of the lever switch 100 and the active lever 50 according to the present embodiment are mentioned above. The rotation range, the release operation area, the close operation area of the active lever 50, the angles θ1, θ2, θ3, and θ4 defined within the rotation range are mentioned above.

Comparison Example 1

Figure 21A:
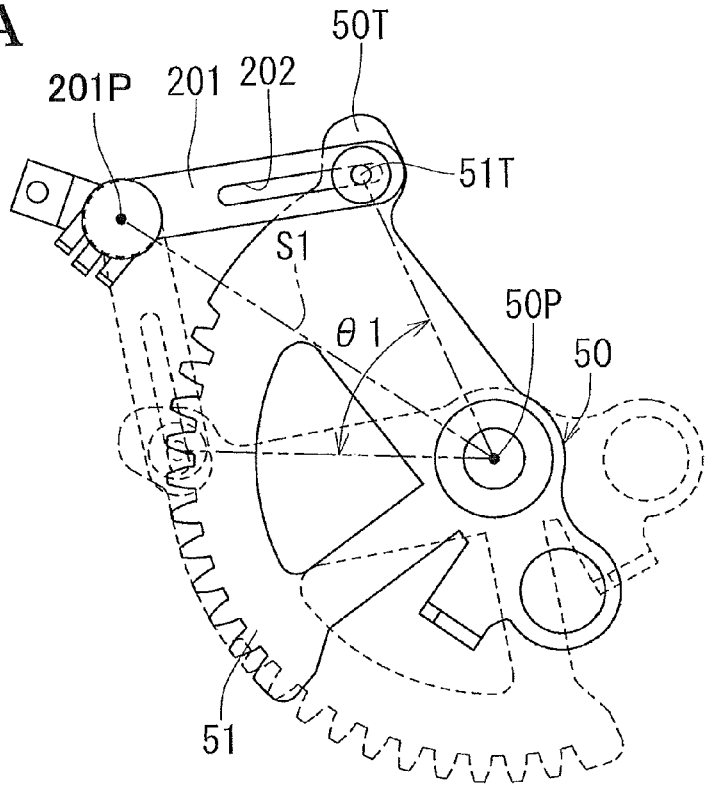
FIGS. 21A and 21B are front views of an active lever and an input lever according to a comparison example 1.
Figure 21B:
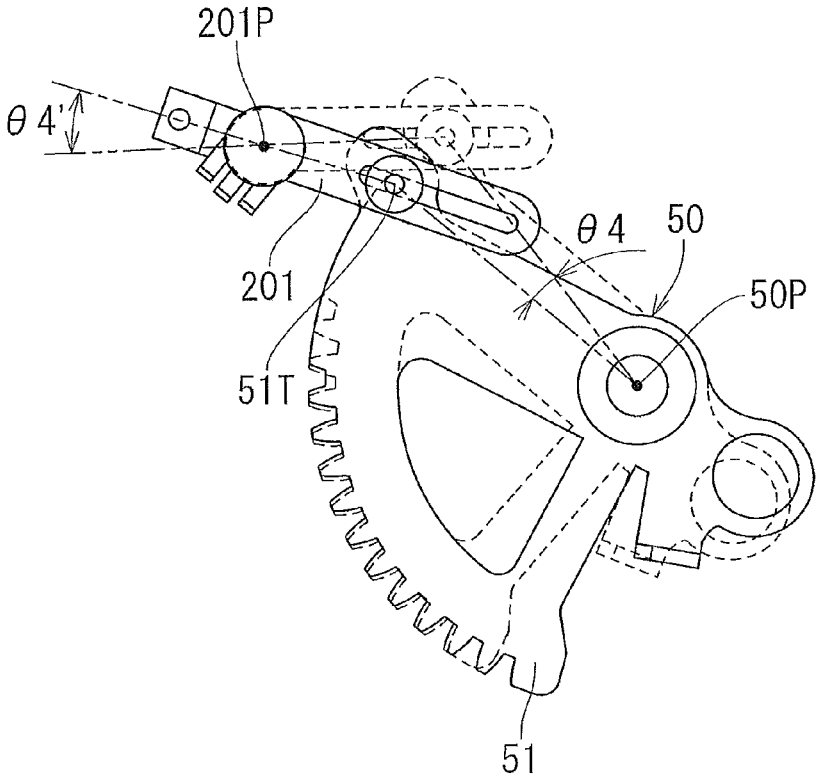

The comparison example 1 is illustrated in FIGS. 21A and 21B. As illustrated in FIGS. 21A and 21B, a cam groove 202 of an input lever 201 is configured to be in parallel with the reference line S1 connecting the rotational center 50P and a rotational center 201P when the cam groove 202 overlaps the reference line S1. The other structures of the comparison example 1 are the same as the structures of the present embodiment.

Comparison Example 2

Figure 22A:
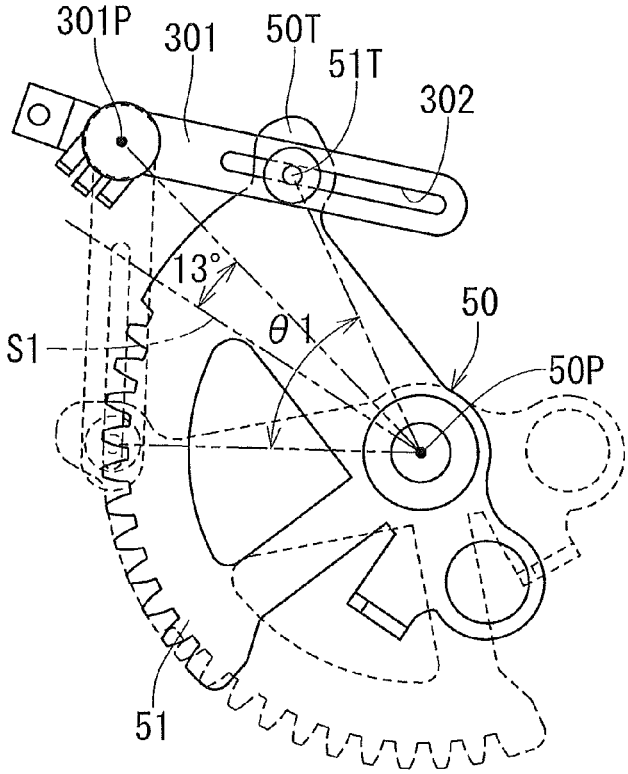
FIGS. 22A and 22B are front views of an active lever and an input lever according to a comparison example 2.
Figure 22B:
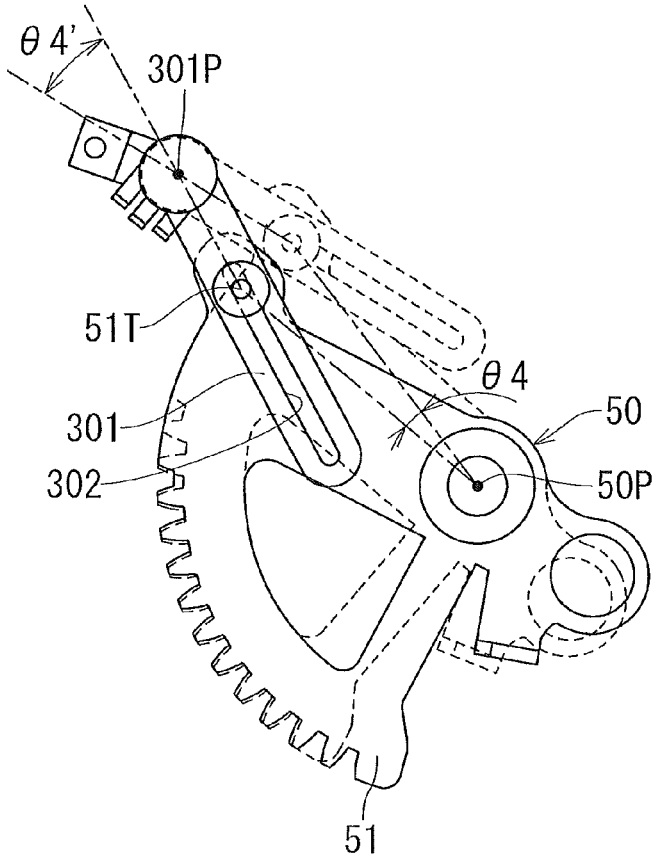
Figure 23:
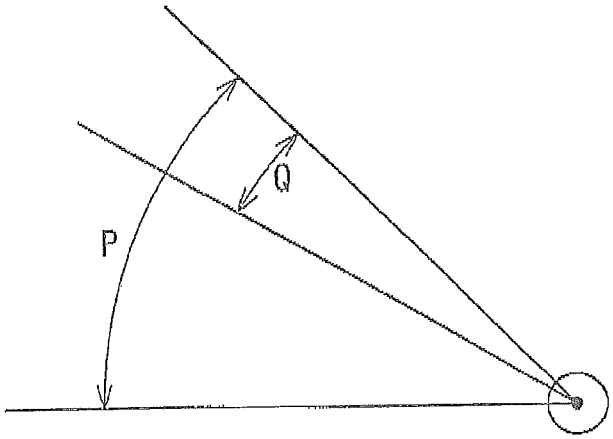
FIG. 23 A PRIOR ART
FIG. 23A is a schematic view illustrating a rotation range and a standby area.
FIG. 23B is a schematic view illustrating an example of a structure where a known technology is used as a position detection of an active rotary member.
Figure 23:
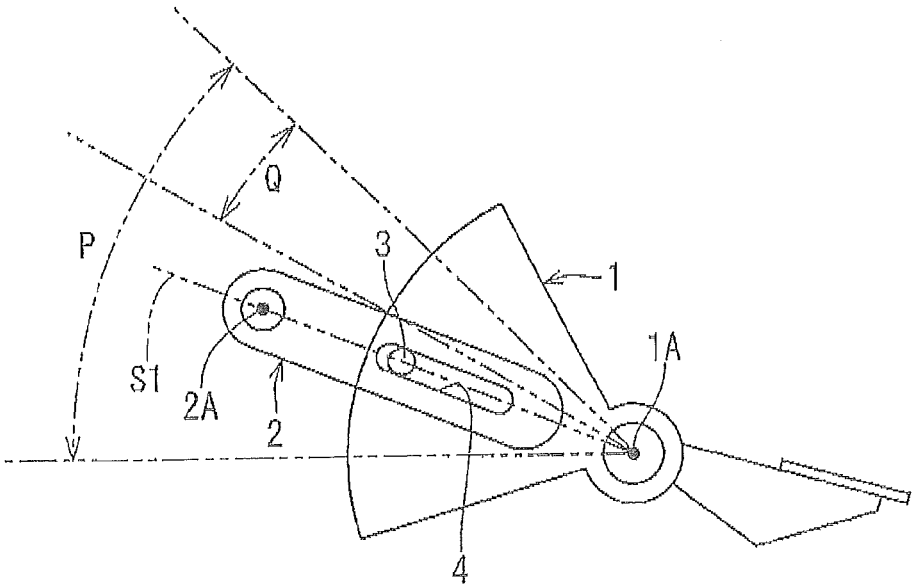
FIG. 23 B PRIOR ART

The comparison example 2 is illustrated in FIGS. 22A and 22B. As illustrated in FIGS. 22A and 22B, a cam groove 302 of an input lever 301 is configured to be in parallel with the reference line S1 in the same way as the comparison example 1. Then, a rotational center 301P of the imputer lever 301 is positioned, being deviated by substantially 13 degrees towards one side (i.e., close to the release operation area) from a bisector of the angle θ1 of the rotation range of the active lever 50. The distance between the rotational centers 50P and 301P, and the minimum distance between the cam projection 51T and the rotational center 301P of the input lever 301 are specified in the same way as the present embodiment.

[Comparison Result]

In FIG. 21A, according to the comparison example 1, the active lever 50 and an input lever 201 each arranged in one end of the rotation range are illustrated by solid lines, respectively. In addition, the active lever 50 and the input lever 201 each arranged in the other end of the rotation range are illustrated by dotted lines, respectively. In FIG. 21B, the active lever 50 and the input lever 201 each arranged in one end of the standby area are illustrated by solid lines, respectively. In addition, the active lever 50 and the input lever 201 each arranged in the other end of the standby area are illustrated by dotted lines, respectively. In FIG. 21B, according to the comparison example 1, a rotation angle θ4' of the input lever 201 while the active lever 50 is rotating from the one end to the other end of the standby area (i.e., inoperative angle θ4=13 degrees) is 20.6 degrees. On the other hand, according to the present embodiment, the rotation angle θ4' (see FIG. 20A) of the input lever 101 within the standby area is 30.7 degrees, which is larger than the comparison example 1.

In FIG. 22A, according to the comparison example 2, the active lever 50 and the input lever 301 each arranged in one end of the rotation range are illustrated by solid lines, respectively. In addition, the active lever 50 and the input lever 301 each arranged in the other end of the rotation range are illustrated by dotted lines, respectively. In FIG. 22B, the active lever 50 and the input lever 301 each arranged in one end of the standby area are illustrated by solid lines, respectively. In addition, the active lever 50 and the input lever 301 each arranged in the other end of the standby area are illustrated by dotted lines, respectively.

As illustrated in FIG. 22B, according to the comparison example 2, the rotation angle θ4' of the input lever 301 within the standby area is 31.4 degrees, which is substantially the same as the present embodiment. However, in order to maintain the engagement between the cam projection 51T and the cam groove 302 in the entire rotation range, the cam groove 302 and the input lever 301 need to be longer than those of the present embodiment by substantially 20%. As a result, a space for the rotation radius and the rotation of the input lever 301 increases. That is, according to the present embodiment, the rotation angle of the input lever 101 within the standby area is increased to an extent substantially equal to that of the comparison example 2 while an enlargement of the input lever 101 of the present embodiment is reduced as compared to the comparison example 2.

The present embodiment is not limited to have the aforementioned structure and may be modified below. For example, the active lever 50 of the closure device 10B may perform either the release operation or the close operation. That is, the rotation range may include only the standby area and the release operation area, or the standby area and the close operation area.

Further, the present embodiment is applied to the closure device 10B of the slide door 90. Alternatively, the present embodiment may be applied to a revolving door lock apparatus attached to a revolving door rotatably provided at a vehicle body. In this case, the revolving door lock apparatus may include the latch and pawl mechanism, the latch drive motor, and the release power transmitting mechanism or the close power transmitting mechanism.

According to the aforementioned embodiment, when the latch drive motor 41M rotates in one direction, the rotational power of the motor 41M is transmitted to the active lever 50, the release power transmitting mechanism (i.e., the open lever 60, the release input lever 170, the slide rotary lever 175, and the release lever 165), and the pawl 30 in this order. The pawl 30 then rotates from the latch engagement position where a rotation of the latch 20 is prohibited to the latch engagement release position where the rotation of the latch 20 is permitted.

Specifically, the active lever 50 is rotatable in a reciprocating manner within the rotation range specified beforehand. When the slide door 90 is operated to open, the active lever 50 is driven to rotate by the motor 41M in a first direction. The active lever 50 rotates from the release member contact position where the active lever 50 is in contact with the release input lever 170 to the release completion position achieved by the active lever 50 moving by the predetermined release operation angle θ2 from the release member contact position, thereby moving the pawl 30 to the latch engagement release position.

The active lever 50 is arranged within the standby area defined between the release member contact position and the release member maximum separation position that is away from the release member contact position in a second direction by the predetermined inoperative angle θ4 when the active lever 50 is in the normal state where the slide door 90 is not operated to open.

The input lever 101 is connected to the active lever 50 so as to be rotatable in conjunction therewith. The input lever 101 rotates about the rotational shaft 101P arranged in parallel with the rotational shaft 50J of the active lever 50 and arranged at a position away from the active lever 50. The input lever 101 overlaps the active lever 50. The cam projection 51T formed in a projecting manner at the active lever 50 slidably engages with the cam groove 102 formed at the input lever 101 so that the cam projection 51T and the cam groove 102 are rotatable in conjunction with each other. The lever switch 100 detects whether or not the active lever 50 is arranged within the standby area based on the rotation position of the input lever 101.

In a case where the cam groove 102 is configured to extend in parallel with the reference line S1 that connects the rotation center 50J of the active lever 50 and the rotation center 101P of the input lever 101 in a state where the cam groove 102 overlaps or matches the reference line S1 when the active lever 50 is arranged at the center of the rotation range, the rotation angle of the input lever 101 per the unit rotation angle of the active lever 50 decreases while the input lever 101 is separated from the center of the rotation range. Thus, according to a case where the standby area is arranged close to one side of the rotation range, the rotation angle of the input lever 101 within the standby area is prevented from being sufficiently enlarged. As a result, the lever switch 100 with a high accuracy is required.

On the other hand, according to the present embodiment, the cam groove 102 extends in parallel with the reference line S1 at a position away from the reference line S1. Then, when the active lever 50 is arranged close to one side of the rotation range, the cam groove 102 and the reference line S1 are in parallel with each other. A rotation angle of the input lever 101 while the active lever 50 is rotating from one end to the other end of the standby area, which is arranged close to one side of the rotation range, increases. Thus, even with a reduced accuracy of the lever switch 100, it is detectable whether or not the active lever 50 is arranged within the standby area, thereby decreasing a cost for the lever switch 100.

Further, according to the aforementioned embodiment, when the latch drive motor 41M rotates in one direction, the rotational force of the motor 41M is transmitted to the active lever 50, the close power transmitting mechanism (i.e, the latch drive lever 25, the seesaw rotary lever 55, and the positioning lever 63), and the latch 20 in this order. The latch 20 rotates in the lock direction where the latch 20 further engages with the striker 40.

Specifically, the active lever 50 is rotatable in a reciprocating manner within the rotation range specified beforehand. When the door 90 is brought in the half-latched state, the active lever 50 is driven to rotate by the motor 41M in the first direction. The active lever 50 rotates from the close member contact position where the active lever 50 is in contact with the seesaw rotary lever 55 and the latch driver lever 25 to the release completion position achieved by the active lever 50 moving by the predetermined close operation angle θ3 from the close member contact position, thereby moving the latch 20 in the lock direction. The slide door 90 is shifted to the fully closed state accordingly.

The active lever 50 is arranged within the standby area defined between the close member contact position and the close member maximum separation position that is away from the close member contact position in the second direction by the predetermined close operation angle θ3 when the active lever 50 is in the normal state where the slide door 90 is not operated to open.

In addition, the cam groove 102 extends in parallel with the reference line S1 at a position away from the reference line S1. Then, when the active lever 50 is arranged close to one side of the rotation range, the cam groove 102 and the reference line S1 are in parallel with each other. A rotation angle of the input lever 101 while the active lever 50 is rotating from one end to the other end of the standby area, which is arranged close to one side of the rotation range, increases. Thus, even with a reduced accuracy of the lever switch 100, it is detectable whether or not the active lever 50 is arranged within the standby area, thereby decreasing a cost for the lever switch 100.

Furthermore, according to the aforementioned embodiment, when the latch drive motor 41M rotates in one direction, the rotational force of the motor 41M is transmitted to the active lever 50, the release power transmitting mechanism (i.e., the open lever 60, the release input lever 170, the slide rotary lever 175, and the release lever 165), and the pawl 30 in this order. The pawl 30 then rotates from the latch engagement position where a rotation of the latch 20 is prohibited to the latch engagement release position where the rotation of the latch 20 is permitted.

In addition, when the latch drive motor 41M rotates in the other direction, the rotational force of the motor 41M is transmitted to the active lever 50, the close power transmitting mechanism (i.e., the latch drive lever 25, the seesaw rotary lever 55, and the positioning lever 63), and the latch 20 in this order. The latch 20 rotates in the lock direction where the latch 20 further engages with the striker 40.

Specifically, the active lever 50 is rotatable in a reciprocating manner within the rotation range specified beforehand. When the slide door 90 is operated to open, the active lever 50 is driven to rotate by the motor 41M in the first direction. The active lever 50 rotates from the release member contact position where the active lever 50 is in contact with the release input lever 170 to the release completion position achieved by the active lever 50 moving by the predetermined release operation angle θ2 from the release member contact position, thereby moving the pawl 30 to the latch engagement release position. In addition, when the slide door 90 is brought in the half-latched state, the active lever 50 is driven to rotate by the motor 41M in the second direction. The active lever 50 rotates from the close member contact position where the active lever 50 is in contact with the seesaw rotary lever 55 and the latch driver lever 25 to the release completion position achieved by the active lever 50 moving by the predetermined close operation angle θ3 from the close member contact position, thereby moving the latch 20 in the lock direction. The door 90 is shifted to the fully closed state accordingly. Further, the active lever 50 is arranged within the standby area defined between the close member contact position and the release member contact position when the active lever 50 is in the normal state where the slide door 90 is not operated to open or the slide door 90 is not operated to close.

In addition, the cam groove 102 extends in parallel with the reference line S1 at a position away from the reference line S1. Then, when the active lever 50 is arranged close to one side of the rotation range, the cam groove 102 and the reference line S1 are in parallel with each other. A rotation angle of the input lever 101 while the active lever 50 is rotating from one end to the other end of the standby area, which is arranged close to one side of the rotation range, increases. Thus, even with a reduced accuracy of the lever switch 100, it is detectable whether or not the active lever 50 is arranged within the standby area, thereby decreasing a cost for the lever switch 100.

Still furthermore, when the active rotary member is positioned within the standby area, the cam groove and the reference line are in parallel with each other.

Accordingly, a position where the rotation angle of the input lever 101 per the unit rotation angle of the active lever 50 is maximized is included in the standby area. Thus, the rotation angle of the input lever 101 while the active lever 50 is rotating from one end to the other end of the standby area that is arranged close to one side of the rotation range increases. Thus, even with a further reduced accuracy of the lever switch 100, it is detectable whether or not the active lever 50 is arranged within the standby area, thereby further decreasing a cost for the lever switch 100.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door latch apparatus for a vehicle, comprising:

a latch adapted to be mounted to a door for the vehicle and rotating by engaging with a striker provided at a vehicle body;

a pawl rotatable between a latch engagement position where a rotation of the latch is prohibited and a latch engagement release position where the rotation of the latch is permitted;

a motor activated in response to an opening and closing operation of the door;

a release power transmitting mechanism transmitting a rotational power of the motor in one direction to the pawl and causing the pawl to rotate from the latch engagement position to the latch engagement release position;

an active rotary member operatively connected to an output shaft of the motor and rotatable in a reciprocating manner within a rotation range specified beforehand, the active rotary member being rotatable in one direction through operation of the motor to cause the release power transmitting mechanism to contact the pawl in a manner releasing the latch and being rotatable in an opposite direction through operation of the motor when the door is in a half-latched state to cause a closing power transmitting mechanism to move the latch from a half-latched position to a fully-latched position, the active rotary member transmitting the rotational power of the motor to the pawl via the release power transmitting mechanism by rotating in a first direction from a release member contact position where the active rotary member is in contact with a portion of the release power transmitting mechanism to a release completion position achieved by the active rotary member moving by a predetermined release operation angle from the release member contact position in a case where the door is operated to open, the active rotary member being arranged in a standby area defined between the release member contact position and a release member maximum separation position separated from the release member contact position in a second direction by a predetermined inoperative angle in a case where the active rotary member is in a normal state where the door is not operated to open;

an input lever rotatable about a rotational shaft which is arranged in parallel with a rotational shaft of the active rotary member and at a position away from the active rotary member, the input lever overlapping the active rotary member;

a cam projection formed in a projecting manner at a surface of the active rotary member where the input lever overlaps;

a cam groove formed at the input lever and slidably engaging with the cam projection for causing the active rotary member and the input lever to operate in conjunction with each other, the cam groove extending at a position away from a reference line that connects a rotational center of the active rotary member and a rotational center of the input lever in a case where the standby area is arranged close to one side of the rotation range and the active rotary member is positioned close to the one side of the rotation range; and a rotational position of the input lever permitting detection of whether or not the active rotary member is arranged within the standby area.

2. The door latch apparatus according to claim 1, wherein when the active rotary member is positioned within the standby area, the cam groove and the reference line are in parallel with each other.

3. A door latch apparatus for a vehicle, comprising:

a latch adapted to be mounted to a door for the vehicle and rotating by engaging with a striker provided at a vehicle body;

a pawl rotatable between a latch engagement position where a rotation of the latch is prohibited and a latch engagement release position where the rotation of the latch is permitted;

a motor activated in response to an opening and closing operation of the door;

a close power transmitting mechanism transmitting a rotational power of the motor in one direction to the latch and causing the latch to rotate in a lock direction in which the latch further engages with the striker for bringing the door in a fully closed state;

an active rotary member operatively connected to an output shaft of the motor and rotatable in a reciprocating manner within a rotation range specified beforehand, the active rotary member being rotatable in one direction through operation of the motor when the door is in a half-latched state to cause the closing power transmitting mechanism to move the latch from a half-latched position to a fully-latched position and being rotatable in an opposite direction through operation of the motor to cause a release power transmitting mechanism to contact the pawl in a manner releasing the latch, the active rotary member transmitting the rotational power of the motor to the latch via the close power transmitting mechanism by rotating in a first direction from a close member contact position where the active rotary member makes contact with a portion of the close power transmitting mechanism to a close completion position achieved by the active rotary member rotating by a predetermined close operation angle from the close member contact position in a case where the door is in a half-latched state, the active rotary member being arranged in a standby area defined between the close member contact position and a close member maximum separation position separated from the close member contact position in a second direction by a predetermined inoperative angle in a case where the active rotary member is in a normal state where the door is not operated to close;

an input lever rotatable about a rotational shaft which is arranged in parallel with a rotational shaft of the active rotary member and at a position away from the active rotary member, the input lever overlapping the active rotary member;

a cam projection formed in a projecting manner at a surface of the active rotary member where the input lever overlaps;

a cam groove formed at the input lever and slidably engaging with the cam projection for causing the active rotary member and the input lever to operate in conjunction with each other, the cam groove extending at a position away from a reference line that connects a rotational center of the active rotary member and a rotational center of the input lever in a case where the standby area is arranged close to one side of the rotation range and the active rotary member is positioned close to the one side of the rotation range; and a rotational position of the input level permitting detection of whether or not the active rotary member is arranged within the standby area.

4. The door latch apparatus according to claim 3, wherein when the active rotary member is positioned within the standby area, the cam groove and the reference line are in parallel with each other.

5. A door latch apparatus for a vehicle, comprising:

a latch adapted to be mounted to a door for the vehicle and rotating by engaging with a striker provided at a vehicle body;

a pawl rotatable between a latch engagement position where a rotation of the latch is prohibited and a latch engagement release position where the rotation of the latch is permitted;

a motor activated in response to an opening and closing operation of the door;

a release power transmitting mechanism transmitting a rotational power of the motor in one direction to the pawl and causing the pawl to rotate from the latch engagement position to the latch engagement release position;

a close power transmitting mechanism transmitting the rotational power of the motor in the other direction to the latch and causing the latch to rotate in a lock direction in which the latch further engages with the striker for bringing the door in a fully closed state;

an active rotary member operatively connected to an output shaft of the motor and rotatable in a reciprocating manner within a rotation range specified beforehand, the active rotary member transmitting the rotational power of the motor to the pawl via the release power transmitting mechanism by rotating in a first direction from a release member contact position where the active rotary member is in contact with a portion of the release power transmitting mechanism to a release completion position achieved by the active rotary member moving by a predetermined release operation angle from the release member contact position in a case where the door is operated to open, the active rotary member transmitting the rotational power of the motor to the latch via the close power transmitting mechanism by rotating in a second direction from a close member contact position where the active rotary member makes contact with a portion of the close power transmitting mechanism to a close completion position achieved by the active rotary member rotating by a predetermined close operation angle from the close member contact position in a case where the door is in a half-latched state, the active rotary member being arranged in a standby area defined between the close member contact position and the release member contact position in a case where the active rotary member is in a normal state where the door is not operated to open or operated to close;

an input lever rotatable about a rotational shaft which is arranged in parallel with a rotational shaft of the active rotary member and at a position away from the active rotary member, the input lever overlapping the active rotary member;

a cam projection formed in a projecting manner at a surface of the active rotary member where the input lever overlaps;

a cam groove formed at the input lever and slidably engaging with the cam projection for causing the active rotary member and the input lever to operate in conjunction with each other, the cam groove extending at a position away from a reference line that connects a rotational center of the active rotary member and a rotational center of the input lever in a case where the standby area is arranged close to one side of the rotation range and the active rotary member is positioned close to the one side of the rotation range; and a rotational position of the input lever permitting detection of whether or not the active rotary member is arranged within the standby area.

6. The door latch apparatus according to claim 5, wherein when the active rotary member is positioned within the standby area, the cam groove and the reference line are in parallel with each other.

* * * * *